US005559576A

United States Patent [19]

Miyazawa et al.

[11] Patent Number: 5,559,576

[45] Date of Patent: Sep. 24, 1996

[54] SOLID PROCESSING AGENT REPLENISHING DEVICE FOR USE IN A PHOTOSENSITIVE MATERIAL PROCESSING APPARATUS

[75] Inventors: Yorikatsu Miyazawa; Yutaka Teraoka; Hideo Ishii, all of Hino, Japan

[73] Assignee: Konica Corporation, Tokyo, Japan

[21] Appl. No.: 380,374

[22] Filed: Jan. 30, 1995

[30] Foreign Application Priority Data

Feb. 16, 1994 [JP] Japan ..... 6-019550
Jun. 10, 1994 [JP] Japan ..... 6-129156

[51] Int. Cl.[6] ..... G03D 13/00

[52] U.S. Cl. ..... 354/298; 354/324; 221/197; 221/263; 221/231

[58] Field of Search ..... 354/324, 298; 430/450, 465, 398–400; 221/97, 197, 287, 231, 232, 263

[56] References Cited

U.S. PATENT DOCUMENTS 5,318,061 6/1994 Saito ..... 354/324 X
5,351,103 9/1994 Komatsu et al. ..... 354/324
5,400,105 3/1995 Koboshi et al. ..... 354/324

FOREIGN PATENT DOCUMENTS

0537788A3 4/1993 European Pat. Off. .
WO92/20013 11/1992 WIPO .

OTHER PUBLICATIONS

Patent Abstracts Of Japan, vol. 12, No. 156 (P–701) May 13, 1988 & JP–A–62 273537 (Konishiroku Photo) Nov. 27, 1987.

*Primary Examiner*—D. Rutledge
*Attorney, Agent, or Firm*—Frishauf, Holtz, Goodman, Langer & Chick

[57] ABSTRACT

The replenishing device for use in a light-sensitive material processing apparatus provided with a processing tank for storing a processing solution therein by which a light-sensitive material is processed, includes a first detector to detect an amount of light-sensitive material processed in the processing tank, and to output a detection signal when the amount has reached a predetermined value; a replenisher to replenish the processing agent from a solid agent storing member to the processing tank. The replenisher incudes a processing agent receiving section which receives the processing agent through an opening of a housing member provided inside of the replenisher in the process of movement from an initial position to a replenishing position, and replenishes it to the processing tank at the replenishing position. The device further includes a sliding member linked with the receiving section which slides on the inside of the housing member, to close the opening at the initial position. The replenishing device still further includes a control section to control the start of movement of the receiving section in accordance with a detection signal sent from the first detector so that the processing agent can be fed into the processing tank, and to control the stop of movement of the receiving section when a second detector detects that the receiving section is located at the initial position after the start of movement of the receiving section.

5 Claims, 19 Drawing Sheets

SOLID PROCESSING AGENT REPLENISHING DEVICE FOR USE IN A PHOTOSENSITIVE MATERIAL PROCESSING APPARATUS

BACKGROUND OF THE INVENTION

The present invention relates to a replenishing device for replenishing a solid processing agent in the photosensitive material processing apparatus. More particularly, the present invention relates to a handy replenishing device used for the processing apparatus in which silver halide photosensitive material is processed.

Conventionally, a processing solution is replenished to the photosensitive material processing apparatus in such a manner that an original solution for replenishment is diluted and dissolved so that a processing solution of the predetermined concentration can be provided. After a predetermined amount of photosensitive material such as rolls of negative photographic films or sheets of photographic paper are processed, a replenishing device, for example, a pump for replenishment use is operated for a predetermined period of time so as to replenish the processing tank with the processing solution. In this case, the amount of processing solution to be replenished is indirectly measured.

After silver halide material has been exposed to light, it is subjected to the processing of development, desilvering, washing and stabilization. Usually, this processing is conducted by an automatic developing apparatus. In this case, a replenishment type developing apparatus is generally adopted, in which a replenisher is fed into the automatic developing apparatus. Due to the foregoing replenishment type developing apparatus, the degree of activity of the processing agent in a processing tank can be controlled to be constant.

In the replenishment type developing apparatus, substance that has dissolved out from photosensitive material can be diluted, and components that have evaporated and consumed can be replenished. As a result of replenishment, a large amount of solution overflows and discharges out of the developing apparatus.

In order to process photosensitive materials on a commercial base, it is necessary to reduce the cost and labor. Also, it is necessary to prevent the public pollution. Further, in order to enhance the commodity value, it is necessary to use a processing solution, the amount of which is as small as possible, and it is also necessary that the processing performance is stable and excellent.

In order to meet the demand described above, a method is disclosed in the official gazette of W092/20013, by which almost all processing agent components are solidified and directly charged into a processing tank.

However, this method is disadvantageous in that a moisture proof measure can not be appropriately taken. That is, when a solid processing agent absorbs moisture, it can not be charged into the processing solution. Further, powder generated from the solid processing agent is scattered and mixed in another processing tank, so that the photographic performance is deteriorated. The present applicant made a U.S. patent application Ser. No. 08/261,847 (Filing date: Jun. 17, 1994) now U.S. Pat. No. 5,489,962 for solving the above problems. The present invention has been achieved for accomplishing the following improvements.

1. Photosensitive materials must be positively processed without failure. Therefore, high reliability is required for the conveyance of a solid processing agent when it is conveyed in the processing apparatus. In case of emergency, it is necessary that the occurrence of a problem is immediately detected and an appropriate countermeasure is taken.

2. It is necessary to prevent a solid processing agent from absorbing the moisture so that the solid processing agent can be more positively conveyed.

SUMMARY OF THE INVENTION

It is an object of the present invention to solve at least one of the above problems. In other words, it is an object of the present invention to provide a replenishing device of the photosensitive material processing apparatus in which the processing performance is enhanced and handy solid processing agents are used.

The first embodiment of the replenishing device of the photosensitive material processing apparatus of the present invention comprises:

a processing tank for accommodating a processing solution in which the photosensitive material is processed;

a first detecting means for detecting an amount of photosensitive material processed in the processing tank, the first detecting means outputting a detection signal when the amount of photosensitive material processed in the processing tank has reached a predetermined value;

a solid processing agent accommodating means for accommodating a solid processing agent charged into the processing tank;

a feed means for feeding the processing agent from the accommodating means;

a housing member having an opening for feeding the processing agent to the processing tank;

a processing agent receiving section capable of moving from an initial position to a feed position corresponding to the opening, the processing agent receiving section receiving the processing agent in the process of movement from the initial position to the feed position, the processing agent receiving section feeding the processing agent to the processing tank at the feed position;

a sliding means for closing the opening at the initial position, the sliding means being linked with the processing agent receiving section and sliding on the inside of the housing member;

a second detecting means for detecting whether or not the processing agent receiving section is located at the initial position;

a third detecting means for detecting whether or not the processing agent is accommodated in the receiving section when the processing agent receiving section is located at the initial position;

an abnormality outputting means for outputting the occurrence of abnormality when the second detecting means detects that the receiving section is not located at the initial position or when the third detecting means detects that the processing agent is accommodated in the receiving section; and a control section for controlling the start of movement of the receiving section in accordance with a detection signal sent from the first detecting means so that the processing agent can be fed into the processing tank and for controlling the stop of movement of the receiving section when the second detecting means detects that the receiving section is located at the initial position after the start of movement of the receiving section.

In addition to the construction of the first embodiment, the second embodiment of the present invention comprises the following construction:

The processing agent accommodating means accommodates a plurality of rows of solid processing agents. In accordance with that, the feed means includes a plurality of rows of receiving sections. The plurality of rows of receiving sections are arranged in the moving direction in such a manner that a difference of phase is provided in each receiving section. The receiving section is provided with a through-hole, and the second and third detecting means detect the through-hole. There is provided a fourth detecting means for detecting whether or not the processing agent is received in the process of movement of the receiving section.

In the present invention, the solid processing agent is defined as a tablet in which powder or granules are compressed so as to be formed into a predetermined configuration, the section of which is circular. "The number of unit replenishing operations" is defined as the number of unit operations conducted by the replenishing mechanism which replenishes the solid processing agent. Further, the clause "A predetermined amount of processing agent is replenished" is defined as follows. In the case where the solid processing agent is replenished to the photosensitive material processing apparatus, a previously determined amount of solid processing agent is replenished, for example, in the case of a negative color film developing tank, one solid processing agent is replenished as the predetermined amount, and in the case of a bleaching tank, two solid processing agents are replenished as the predetermined amount.

The mode of operation of the present invention will be described below. Photosensitive material is set in the photosensitive material processing apparatus and then processed in the processing tank in which the solid processing agent is dissolved. In parallel with this processing operation, an amount of photosensitive material to be processed is detected by the processing amount detecting means. When the processing amount detected by the processing amount detecting means is increased to a predetermined value, the predetermined amount control means operates as follows. In order to replenish the predetermined amount of processing agent by the feed means, the replenishing mechanism for replenishing the solid processing agent conducts at least one time of unit replenishing operation. Due the foregoing, the replenishing operation is carried out at more accurate replenishing time.

The solid processing agent is inserted into a holding section of the processing agent receiving member for replenishing the solid processing agent into the processing tank, or the solid processing agent is discharged from the holding section of the processing agent receiving member. At this time, the detecting means detects whether or not the solid processing agent is held by the holding section, and detects whether the solid processing agent is inserted into the holding section or the solid processing agent is discharged from the holding section. As a result, it is possible to confirm the conveyance condition of the solid processing agent.

The detecting means detects the abnormal charge of the solid processing agent in which the solid processing agent is not inserted into the holding section from the accommodating container. Also, the detecting means detects the abnormal discharge of the solid processing agent in which the solid processing agent is not discharged from the holding section. Accordingly, the occurrence of abnormality can be immediately detected.

The solid processing agent is held by the holding section of the processing agent receiving member. The solid processing agent is conveyed by the rotation of the rotor driven by the drive means of the solid processing agent receiving member. When the rotor is rotated in the reverse direction, the solid processing agent is prevented from absorbing the moisture by a moisture-proof means. Due to the foregoing, it is possible that the solid processing agent is stored in the accommodating container without staying in the rotor and the solid processing agent is prevented from absorbing the moisture. Under the above condition, the solid processing agent can be conveyed with a simple structure.

The number of rows of solid processing agents accommodated in the rotor is the same as that of rows of solid processing agents accommodated in the accommodating container. Accordingly, in addition to the aforementioned mode of operation, the accommodated solid processing agents do not interfere with each other in the rotor and they can be held at predetermined positions. Consequently, the solid processing agents can be positively conveyed.

When the solid processing agents are fed, two or three solid processing agents do not drop simultaneously, but they drop successively, so that the interference of solid processing agents can be avoided.

There is provided a housing member having an inlet and an outlet of the solid processing agent. On an internal circumferential surface of the housing member, a holding section is provided, by which the solid processing agents are rotatably held. Further, there is provided a processing agent receiving member having a moisture-proof means, and this processing agent receiving member is driven by the drive means for preventing the processing agent from absorbing the moisture. Further, the outlet of the housing member is opened and closed by a shutter member, and only when the processing agent is replenished, the outlet is opened. In this way, moisture-proof effect can be provided.

DETAILED DESCRIPTION OF THE PREFERRED EMBODIMENT

With reference to the accompanying drawings, a solid processing agent replenishing device used for the photosensitive material processing apparatus (referred to as an automatic developing apparatus hereinafter) of the example of the present invention will be explained below.

[EXAMPLE 1]

Figure 1:
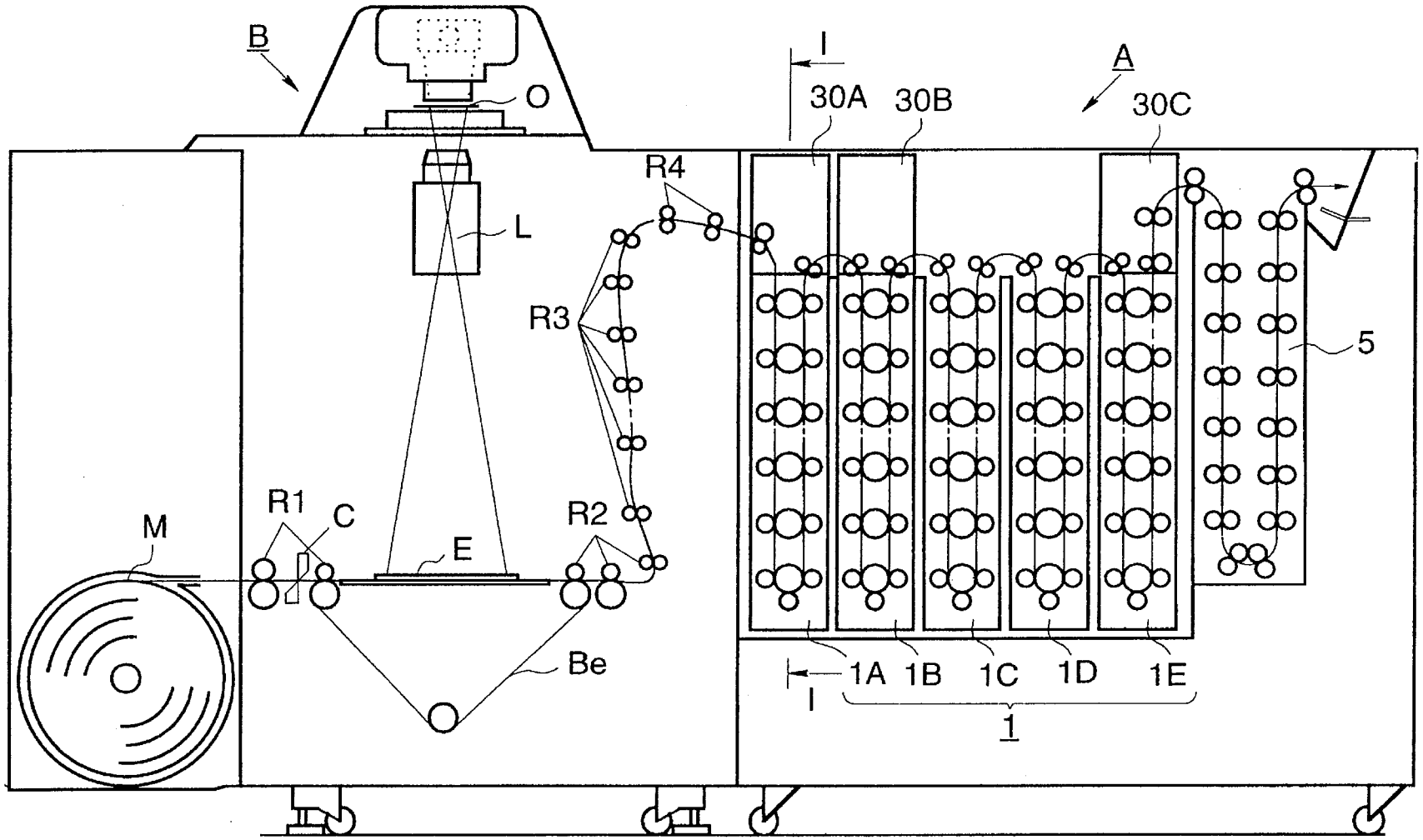
FIG. 1 is a schematic illustration showing an outline of the printer processor of Example 1.

FIG. 1 is a schematic illustration showing an outline of the printer processor. As illustrated in the drawing, the printer processor includes an automatic developing apparatus A and a photographic printer B which are integrated with each other. In FIG. 1, in the left lower portion of the photographic printer B, there is provided a magazine M in which a roll of photographic paper, which is an unexposed silver halide photographic material, is accommodated. The photographic paper is pulled out from the magazine M and conveyed by the feed rollers R1 and cut into a predetermined size by the cutter C. In this way, a sheet of photographic paper can be provided. This sheet of photographic paper is conveyed by the belt conveyance means Be. Then an image of the original O is exposed onto the sheet of photographic paper by a light source and lens L in the exposure section E. The exposed sheet of photographic paper is further conveyed by a plurality of pairs of feed rollers R2, R3 and R4, so that the sheet of photographic paper is introduced into the automatic developing apparatus A. In the automatic developing apparatus A, the sheet of photographic paper is successively conveyed by a roller conveyance means (the reference numeral is not attached to the means) into the color development tank 1A, bleaching and fixing tank 1B and stabilizing tanks 1C, 1D, 1E, wherein these tanks substantially compose a processing tank 1. Due to the foregoing, the sheet of exposed photographic paper is subjected to color development, bleaching and fixing processing and stabilizing processing. After the processing has been completed, the sheet of photographic paper is dried by the drying section 5, and then discharged outside of the apparatus.

In this connection, the one-dotted chain line in the drawing shows a conveyance passage of the silver halide photosensitive material. In this example, the photosensitive material is cut into a sheet and introduced into the automatic developing apparatus A, however, a strip-shaped photosensitive material may be introduced into the automatic developing apparatus A. In this case, the processing efficiency can be enhanced when an accumulator for temporarily stocking the photosensitive material is provided between the automatic developing apparatus A and photographic printer B. Of course, the automatic developing apparatus A of the present invention may be constructed integrally with the photographic printer B, or alternatively the automatic developing apparatus A of the present invention may be constructed separately from the photographic printer B. Of course, the silver halide photosensitive material processed by the automatic developing apparatus A of the present invention is not limited to the exposed photographic paper, but an exposed negative film may be applied to the automatic developing apparatus A of the present invention. The explanation of the present invention is made under the condition that the automatic developing apparatus A includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic developing apparatus having four tanks including a color developing tank, bleaching tank, fixing tank and stabilizing tank. There are provided constant temperature tanks 2A, 2B, 2E, which are solid processing agent charging sections, respectively communicated with the color development tank 1A, bleaching and fixing tank 1B and stabilizing tanks 1E.

Figure 2:
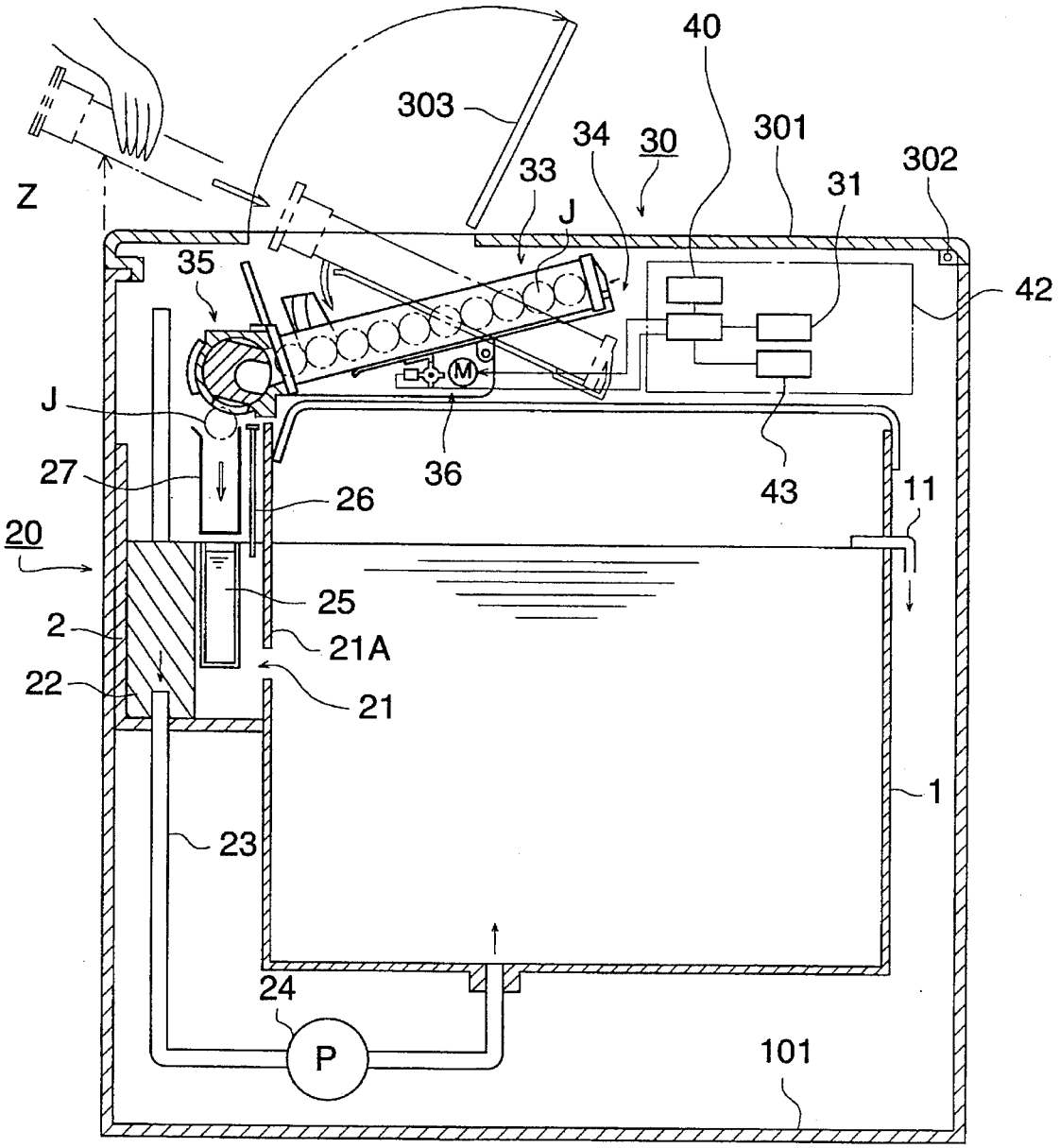
FIG. 2 is a sectional view taken on line I—I in FIG. 1.

FIG. 2 is a sectional view taken on line I—I in FIG. 1 showing the automatic developing apparatus. In this case, the construction of the bleaching and fixing tank 1B and that of the stabilizing tanks 1C, 1D, 1E are the same as the construction of the color development tank 1A. Therefore, the explanation of the processing tank 1 can be applied to all tanks of the color development tank 1A, bleaching and fixing tank 1B, and stabilizing tanks 1C, 1D, 1E. The construction of the bleaching and constant temperature tank 2B and that of the stabilizing and constant temperature tank 2E are the same as that of the color constant temperature tank 2A. Therefore, the explanation of the constant temperature tank 2 can be applied to all the constant temperature tanks described above. In this connection, for enhancing the understanding of the invention, the conveyance means for conveying the photosensitive material is omitted in the drawing. In this example, explanations will be made under the condition that tablets of solid processing agent are used. However, it should be noted that the solid processing agent replenishing device of the present invention can be applied to an apparatus in which packed granular processing agents or packed powder processing agents are used.

The processing tank 1 for processing the photosensitive material includes a solid processing agent charging section 20 for supplying a solid processing agent J, the solid processing agent charging section 20 being integrally provided outside the separation wall of the processing tank 1, and a constant temperature tank 2. The processing tank 1 and constant temperature tank 2 are separated by a partition wall 21 on which a communicating hole 21 is formed so that the processing solution can be communicated through the communicating hole 21. Since an enclosure 25 for receiving the tablets J of solid processing agent is provided in the solid processing agent charging section 20 disposed at an upper position of the constant temperature tank 2, the tablets J of solid processing agent are not moved to the processing tank 1 in the form of a solid body. In this connection, the enclosure 25 is made of material such as a net or filter so that the processing solution can pass through the enclosure 25, however, the solid processing agent J can not pass through the enclosure 25 until it is dissolved. A filter 22 is disposed below the constant temperature tank 2 in such a manner that the filter 22 can be replaced. The filter 22 removes paper scraps and others in the processing solution. A circulation pipe 23 connected with the suction side of a circulation pump 24 (circulation means) is inserted into the filter 22 passing through the lower wall of the constant temperature tank 2. The circulation system includes the circulation pipe 23 forming a circulation passage of the processing solution, and also includes-the circulation pump 24 and the processing tank 1. One end of the circulation pipe 23 is communicated with the delivery side of the circulation pump 24, and the other end penetrates a lower wall of the processing tank 1, so that the circulation pipe 23 is communicated with the processing tank 1. Due to the foregoing construction, when the circulation pump 24 is operated, the processing solution is sucked from the constant temperature tank 2 and discharged into the processing tank 1, so that the discharged processing solution is mixed with the processing solution in the processing tank 1, and then sent to the constant temperature tank 2. In this way, the processing solution is circulated. The circulating direction of the processing agent is not limited to the direction shown in FIG. 2, but the direction may be reverse to that shown in FIG. 2.

A waste solution pipe 11 is provided for permitting the processing solution in the processing tank 1 to overflow, so that the solution level can be maintained constant and an increase in the components conveyed from other tanks into the processing tank 1 can be prevented. Further, an increase in the components oozing out from the photosensitive material can be prevented. A rod-shaped heater 26 penetrates an upper wall of the constant temperature tank 2, and is dipped in the processing solution in the constant temperature tank 2. The processing solution in the constant temperature tank 2 and processing tank 1 is heated by this heater 26. In other words, the heater 26 is a temperature regulating means for regulating the temperature of the processing solution in the processing tank 1, so that the temperature can be controlled in an appropriate range, for example, in a range from 20° to 55° C.

A throughput information detecting means 31 is disposed at an entrance of the automatic developing apparatus A, and detects the throughput of the photosensitive material to be processed. This throughput information detecting means 31 is comprised of a plurality of detecting members that are disposed in a transverse direction. This throughput information detecting means 31 detects the width of photosensitive material, and the result of detection is used for counting the detection time. Since the conveyance speed of photosensitive material is previously set in a mechanical manner, the throughput of photosensitive material, that is, the area of processed photosensitive material can be calculated from the width and time information. In accordance with the result of detection conducted by the throughput detection means, the solid processing agent is replenished by each solid processing agent replenishing device. An infrared ray sensor, microswitch and ultrasonic sensor capable of detecting the width and conveyance time of photosensitive material can be used for this throughput information detecting means 31. A means for indirectly detecting the area of processed photosensitive material may be used for this throughput information detecting means 31. For example, in the case of the printer processor, a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31 may be disposed at an appropriate position so that detection can be conducted after processing or while the photosensitive material is being processed. In the above explanation, detection is conducted on the area of processed photosensitive material, however, the present invention is not limited to the specific example. For example, any values proportional to the throughput of photosensitive material may be adopted. For example, a concentration of the processing solution in the processing tank or a change in the concentration may be used. The throughput detection means 31 is provided with a memory for storing the result of a feed shortage counter. When the processing is continued in the case where the solid processing agent replenishing means is out of order or the solid processing agent lacks, an amount of lack of the processing agent is stored in the counter. When the solid processing agent replenishing device is recovered, the counter memory is called, and the solid processing agent is continuously replenished. In this connection, when problems are caused by the delay of replenishment of the solid processing agent, for example, when a delay of replenishment of even one tablet is not permitted because the activity of the processing agent in the processing tank is lowered and serious problems are encountered, the counter memory does not conduct counting, but the automatic developing apparatus is immediately stopped. It is preferable that one set of throughput detection means 31 is provided in one set of automatic developing apparatus A, however, one set of throughput detection means 31 may be provided in each processing tank 1A, 1B, 1C, 1D, 1E.

The replenishing device control section 42 is an electric circuit system for controlling the solid processing agent replenishing device 30. The replenishing device control section 42 includes a predetermined amount control means 40 and a predetermined amount detection means described later. The predetermined amount control means 40 conducts a controlling operation in such a manner that a predetermined amount of the processing agent is replenished by the feed means when the throughput detected by the throughput detection means has reached the predetermined value.

The abnormality detection and display means 43 detects and displays the occurrence of abnormality when the solid processing agent is not charged from the accommodation container to the holding section of the processing agent receiving member. Further, when the solid processing agent is not discharged from the holding section of the processing agent receiving member into the processing tank, the abnormality detection and display means 43 detects and displays the occurrence of abnormality.

The solid processing agent replenishing device 30 of the present invention is arranged above the processing tank of the photosensitive material processing apparatus in which exposed photosensitive material is processed. The solid processing agent replenishing device 30 of the present invention includes an accommodation container 33, accommodation container charging section 34, feed means 35, chute 27, and drive means 36. This solid processing agent replenishing device 30 is airtightly closed by an upper cover 301. The upper cover 301 is rotatably connected with the main body 101 accommodating the processing tank 1 and the constant temperature tank 2 through a support shaft 302 provided at the rear of the main body. When the upper cover 301 is raised in the direction of Z illustrated by a one-dotted chain line in the drawing so that the front and upper sides with respect to an operator can be widely opened, it is possible to inspect the solid processing agent replenishing device 30 and to replace the filter 22. There is provided a skylight 303 capable of freely opened and closed on an upper surface of the upper cover 301. When the skylight 303 is opened in the direction of the one-dotted chain line in the drawing, the accommodation container 33 is attached to and detached from the apparatus.

Figure 3:
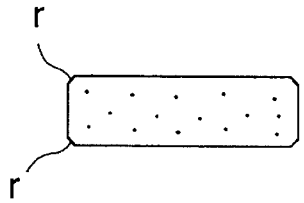
FIGS. 3(A) to 3(D) are sectional views showing various configurations of the solid processing agents of Example 1.
Figure 3:
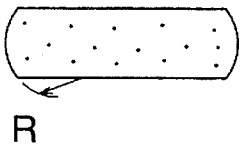
Figure 3:
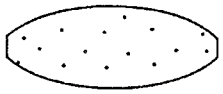
Figure 3:
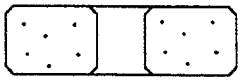

FIGS. 3(A) to 3(B) are sectional views showing various configurations of the solid processing agent. FIG. 3(A) is a sectional view of the cylindrical flat tablet type solid processing agent J, wherein the configuration is circular and the corners are chamfered by the radius of curvature of r. FIG. 3(B) is a sectional view of the flat tablet type solid processing agent J, wherein the configuration is circular, and the upper and lower surfaces are flat, and the circumferential surface is formed convex by the radius of curvature of R. FIG. 3(C) is a sectional view of the tablet type solid processing agent J, wherein the configuration is flat, and the upper and lower surfaces are formed spherical. FIG. 3(D) is a sectional view of the tablet type solid processing agent J, wherein the configuration is a doughnut-shape having a hole at the center.

Figure 4:
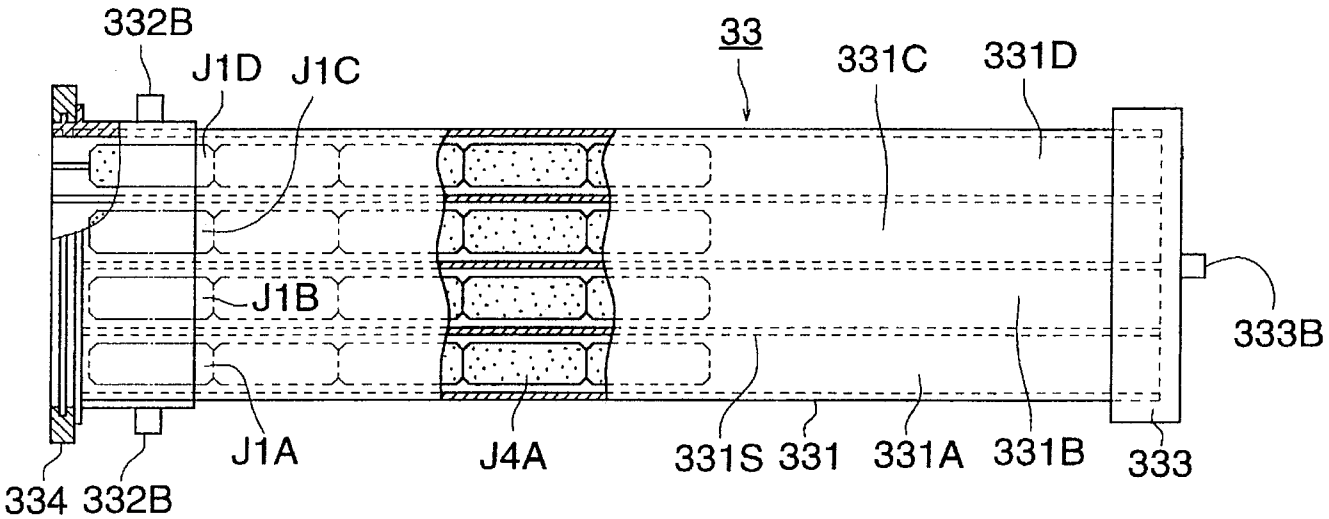
FIG. 4(A) is a plan view of the accommodating container of Example 1.
FIG. 4(B) is a side view of the accommodating container of Example 1.
Figure 4:
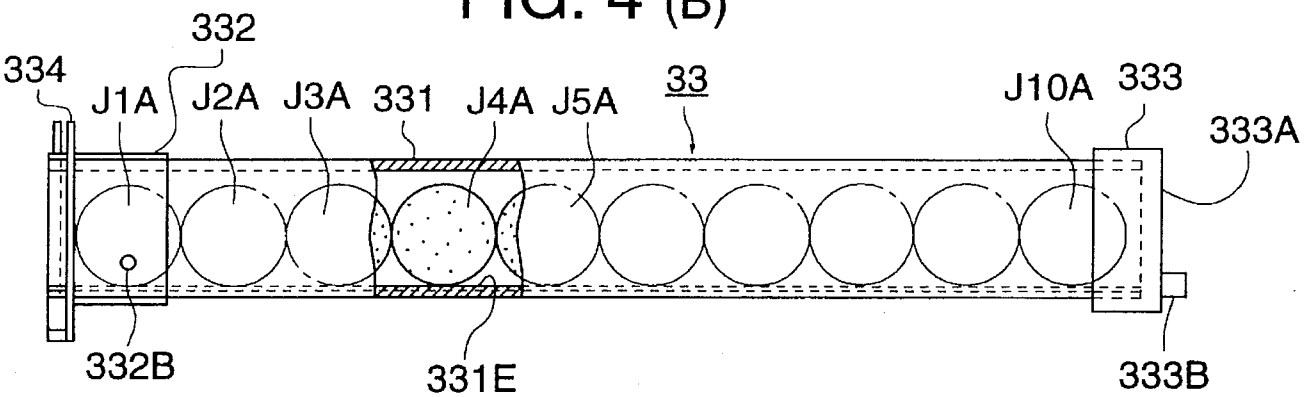
Figure 5:
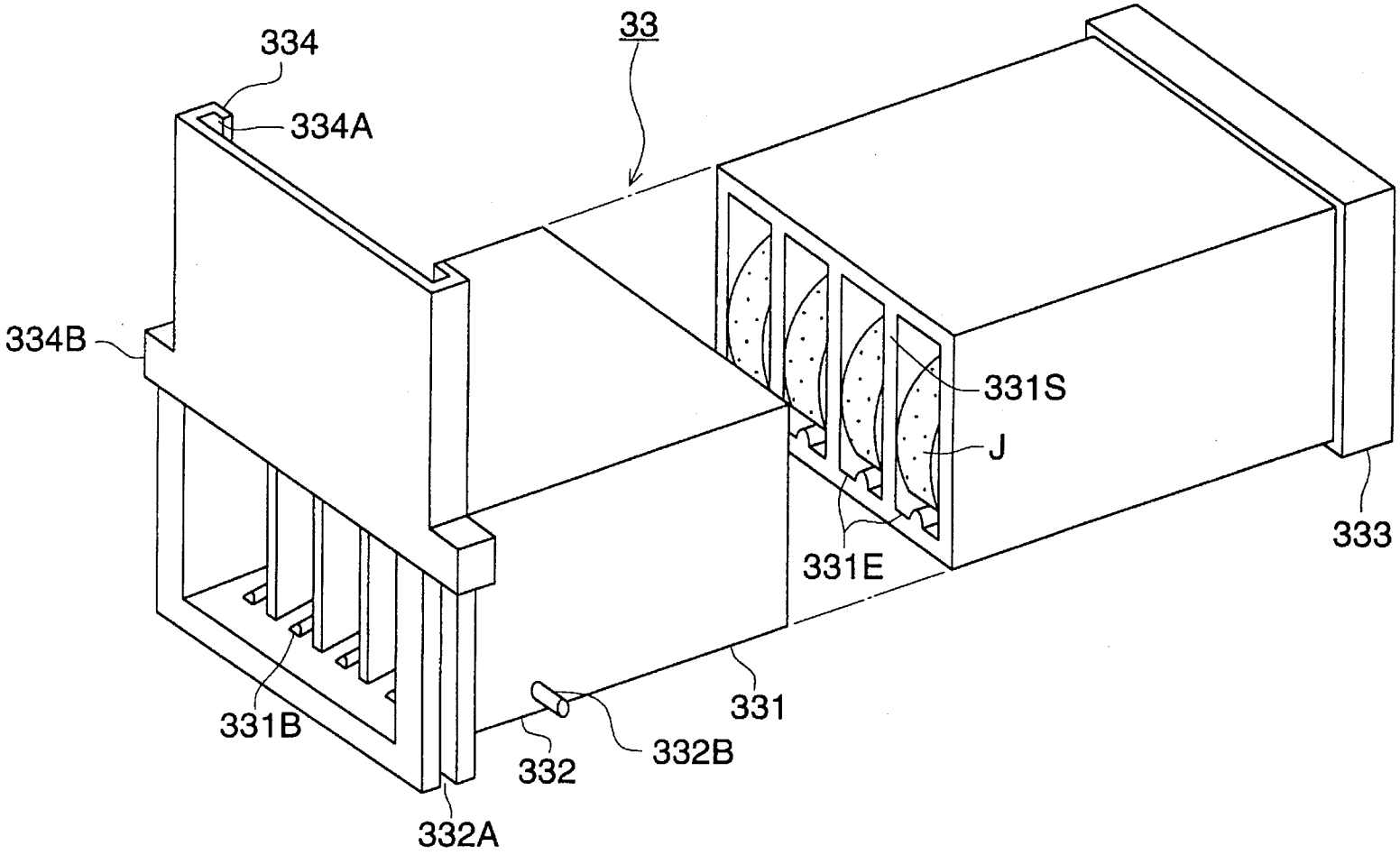
FIG. 5 is a perspective view of the accommodating container of Example 1.

FIG. 4(A) is a plan view of the accommodation container, and FIG. 4(B) is a side view of the accommodation container. In this case, FIG. 4(A) is a plan view, wherein a portion of FIG. 4(A) is a partially exploded sectional view, and FIG. 4(B) is a side view of the accommodation container 33, wherein a portion of FIG. 4(B) is a partially exploded sectional view. FIG. 5 is a perspective view of the accommodation container. As illustrated in FIGS. 4(A), 4(B) and 5, the accommodation container 33 includes: a hollow-square-pole-shaped packaging body 331 for accommodating a plurality of tablet type solid processing agents J; an outlet member 332 connected with one of the openings of the packaging body 331, the outlet member 332 having a discharge opening from which the solid processing agent can be discharged; a cap member 333 for closing the other opening of the packaging body 331; and a sliding cover 334 capable of moving upward and downward sliding a rail section 332A of the outlet member 332. In the packaging body 331, three partition walls 331S are integrally fixed. By the three partition walls 331S, the inside of the packaging body 331 is divided into four small chambers 331A, 331B, 331C and 331D. In each chamber, the approximately cylindrical tablets of solid processing agent J are longitudinally accommodated under the condition that each outer circumference is externally contacted with the inside wall of the chamber. Specifically, 10 tablets of solid processing agent J1A to J10A are accommodated in the first chamber 331A, and 10 tablets of solid processing agent J1B to J10B are accommodated in the second chamber 331B. In the same manner, the tablets J1C to J10C and J1D to J10D are respectively accommodated in the chambers.

A projection 331E is projected from the bottom surface of each chamber of the packaging body 331. This projection 331E comes into a point of the outer circumferential surface of the tablet of solid processing agent J, so that the tablet can be easily moved, and powder separated from the tablet of solid processing agent J drops from the top of the projection 331E. Separated powder accumulates in a groove formed under the projection 331E. Accordingly, even when the powder is deposited in the groove, no problems are caused because the tablet of solid processing agent J moves on the projection 331E.

A rail 332A is provided on both outer sides of the opening of the outlet member 332, and slidably engages with grooves 334A formed on both sides of the sliding cover 334.

Projections 334B projecting from both lower ends of the sliding cover 334 engage with the opening and closing regulating members 355 described later, so that the sliding cover 334 can be automatically closed.

Pins 332B are protruded from both sides of the outlet member 332. The pins 332B are engaged with the cam grooves of an accommodating container charge section 34 described later.

The pins 332B are pushed by the pushing member of the accommodation container charge section 34 described later, and the accommodating container 33 is pressed against a reference surface of the feed means 35. A plurality of discriminating projections 333B are integrally provided on the back surface 333A of the cap member 333, and a wrong accommodating container 33 in which a different processing agent is accommodated is prevented from being attached to the apparatus.

Figure 6:
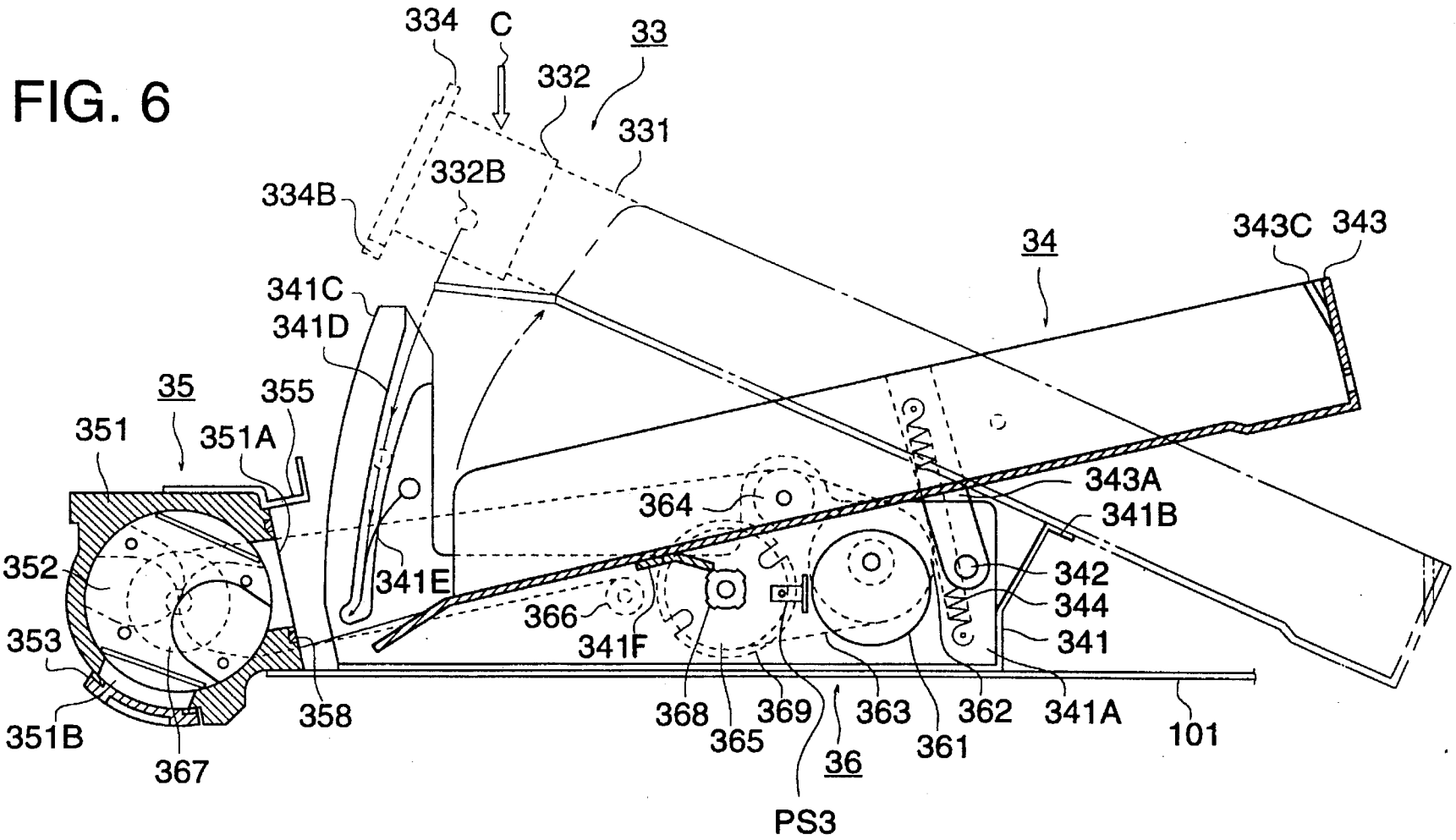
FIG. 6 is a sectional side view of the accommodating container charging section, feed means and drive means of Example 1.

FIG. 6 is a sectional side view of the accommodating container charge section, feed means, and drive means. As illustrated in the drawing, a fixed frame 341 of the accommodating container charging section 34 and a housing member 351 of the feed means 35 are fixed on an upper portion of the main body 101. Support shafts 342 are protruded from both side plates 341A of the fixed frame 341 at the right end shown in the drawing. The support shafts 342 are engaged in holes disposed at a lower end of an arm 343A fixed on both sides of a container holding member 343 for holding the accommodating container 33, so that the container holding member 343 can be oscillated around the support shaft 342. The side plate 341A and arm 343A are respectively provided with a fixing pin, and a tension spring 344 is attached to the fixing pin. Therefore, as illustrated by a one-dotted chain line in the drawing, the container holding member 343 is rotated clockwise being pushed by the spring, and the bottom portion of the container holding member 343 comes into contact with a stopper portion 341B protruding to a right upper portion of the fixed frame 341. Then the movement of the container holding member 343 is stopped, and the container holding member 343 is maintained in a condition before the accommodating container 33 is mounted.

At a position close to the left end of the side plate 341A of the fixed frame 341, there is provided a claw portion 341C, in which a circular guide groove 341D is formed, wherein the circular guide groove 341D is also pivotable around the support shaft 342. The accommodating container 33 is charged to the container holding member 343 of the accommodating container charging means 34, and the accommodating container holding member 343 is oscillated around the support shaft 342, so that the left end portion of the container holding member 343 is pushed downward in the direction C shown in the drawing. Then the guide pin 332B of the accommodating container 33 advances in the guide groove 341D while the guide pin 332B is being pushed downward by a pushing member 343C of the accommodating container charging means 34. An L-shaped groove portion 341E is formed in the lowermost portion of the guide groove 341D. When the pin 332B enters this L-shaped groove 341E being pushed by the pushing member 343C, the front of the accommodating container 33 closely comes into contact with an entrance portion 351A of the feed means 35.

The feed means 35 is disposed in the housing member 351 in such a manner that the feed means 35 can be rotated on an inner circumferential surface of the housing member 351. The feed means 35 includes a rotatable solid processing agent receiving member (rotor) 352, and a shutter section 353 for opening and closing the outlet portion 351B, wherein the solid processing agent receiving member (rotor) 352 is a member by which a predetermined amount of solid processing agent is received from the inlet portion 351A and moved to the outlet portion 351B.

A frame-shaped resilient packing 358 is embedded in the periphery of the opening on the end surface of the inlet portion 351A of the housing member 351. When the sliding cover 334 of the accommodating container 33 is closely contacted with the inlet portion 351A, the outside air can be shut off by the frame-shaped resilient packing 358, so that moisture-proofing effect can be provided.

Next, the drive means for driving the solid processing agent replenishing device will be explained below. The drive means 36 of the present invention is arranged under the accommodating container charge section 34. A timing belt 363 wound around the timing pulley 362 mounted on the drive shaft of the motor 361 rotates a pulley 367 mounted on the rotational shaft of the processing agent receiving member 352 through pulleys 364, 365 and a tension pulley 366. A cam 368 is mounted on the same shaft as that of the pulley 365. On the other hand, a claw portion 341F is fixed onto the bottom surface of the container holding member 343. The claw portion 341F is engaged with the cam 368. When the motor 361 is driven, the pulley 365 and cam 368 are rotated. Then a protrusion of the cam 368 pushes up the claw portion 341F. Accordingly, when the cam 368 is rotated, shocks are repeatedly given to the claw portion 341F and the container holding member 343 integrally formed with the claw portion. Due to the effect of shocks, the solid processing agent J accommodated in the accommodating container 33 rolls on an incline in the packaging body 331 and advances to the outlet without being stopped in the middle of movement.

The pulley 365 and the cutout disk 369 having two cutouts are mounted on the same shaft. When a photo-interrupter type optical sensor PS3 detects the cutout portion (detection of the origin), a positional detection signal is outputted, and the processing agent receiving member 352 is controlled to rotate by a half revolution.

Figure 7:
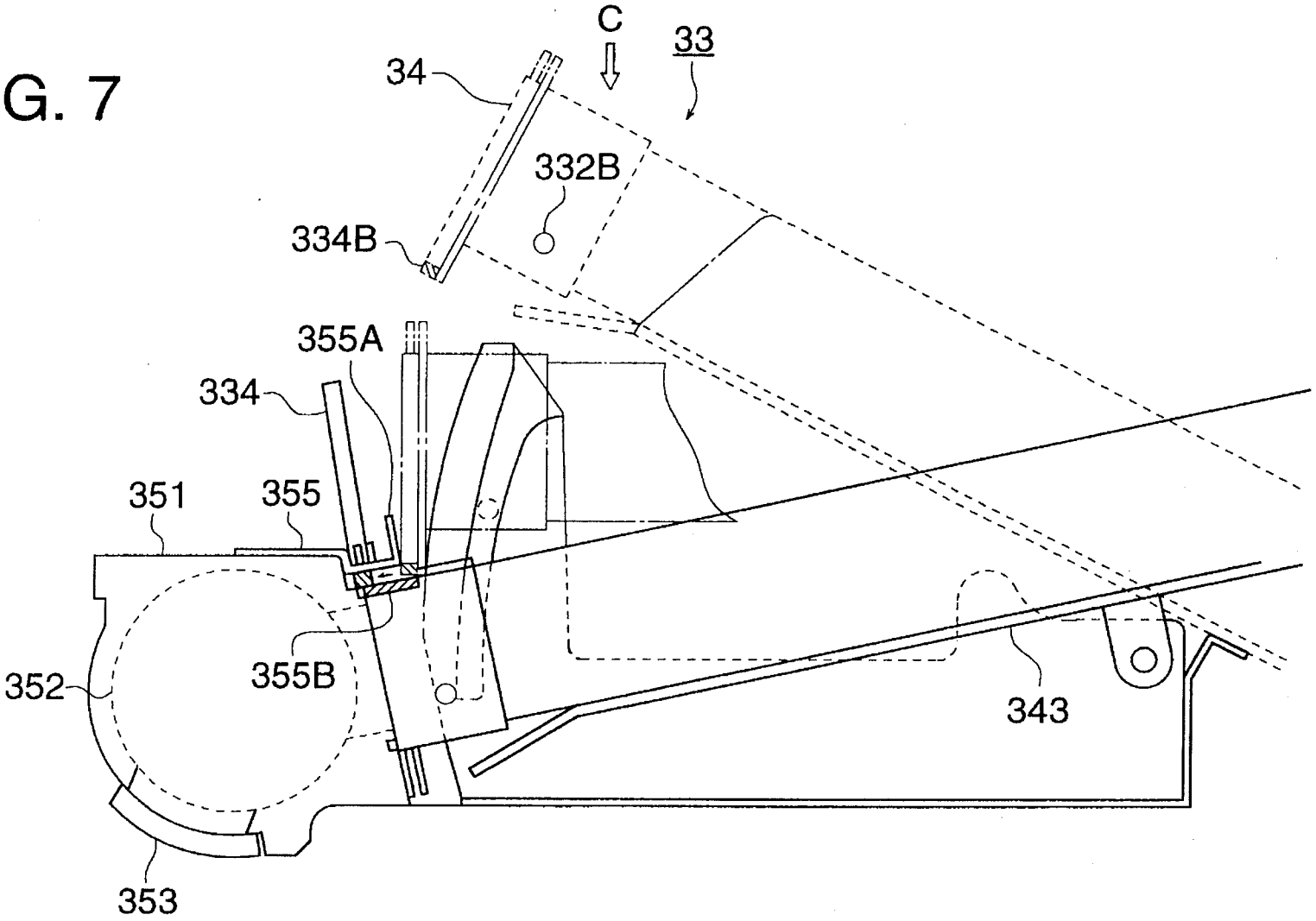
FIG. 7 is a side view for explaining the opening and closing operation of the sliding cover of the accommodating container of Example 1.

FIG. 7 is a side view for explaining the opening and closing operation of the sliding cover of the accommodating container. As illustrated in the drawing, at an upper position of the inlet portion of the housing member 351, there is provided an opening and closing regulating member 355 for regulating the opening and closing operation of the sliding cover 334. When the accommodating container 33 provided in the accommodating container charging section 34 is pushed downward from the initial position (shown by a broken line in the drawing) in the direction of arrow C in the drawing, the accommodating container 33 reaches the intermediate position (shown by a one-dotted chain line). Then the descending motion of a protrusion 334B of the sliding cover 334 is stopped by the lower stopper 355B of the opening and closing regulating member 355. When the accommodating container 33 is further oscillated, the opening of the outlet opening member 332 of the accommodating container 33 is gradually opened since the sliding cover 334 can not further go downward. When the downward motion of the accommodating container 33 is stopped at a predetermined position, the opening of the outlet member 332 is completely opened by resilience, and the solid processing agent tablet J in the accommodating container 33 is sent to the feed means 35. This complete opening condition is shown by a solid line in the drawing.

When all solid processing agent tablets J in the accommodating container 33 have been successively consumed, a remainder detection signal is generated, and the accommodating container 33 is replaced in accordance with the signal. When the accommodating container 33 is withdrawn backward, the accommodating container 33 and container holding member 343 are rotated clockwise by the force of the tension spring 344 (shown in FIG. 6), so that the left end portion is raised. In this ascending process, the upper stopper 355A of the opening and closing regulating member 355 stops the motion of the sliding cover 334 when the rise of the protrusion 334B is regulated, and only the main body composed of the packaging body 331 and the outlet member 332 of the accommodating container 33 is raised, so that the opening portion of the outlet member 332 (shown in FIG. 6) is closed by the sliding cover 334. Further, in the latter half process in which the accommodating container 33 is raised, the apparatus is returned to the initial condition, which is an upper dead point.

Figure 8:
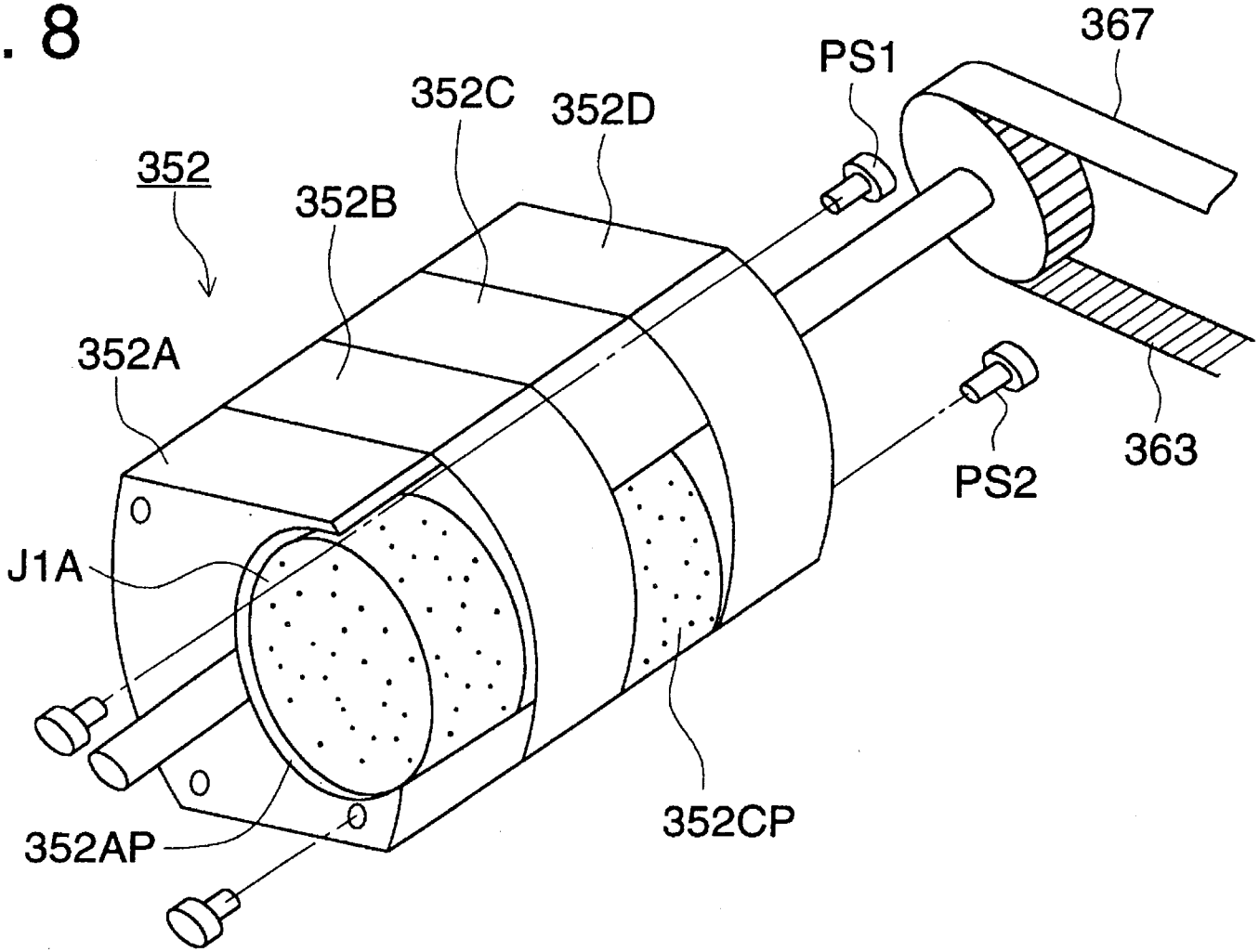
FIG. 8 is a perspective view of the feed means of Example 1.

FIG. 8 is a perspective view of the feed means. As illustrated in the drawing, the processing agent receiving member 352 is comprised of 4 rotors 352A, 352B, 352C, 352D which are integrally mounted on the same shaft. Each rotor is provided with one pocket (352AP, 352BP, 352CP, 352DP). Each pocket can accommodate one solid processing agent. The positional phase of each pocket is shifted. Therefore, when the processing agent receiving member 352 is rotated by one revolution, the solid processing agent J1C is charged into the first pocket 352CP from the discharge opening of the accommodating container 33 (shown in FIG. 7). Then the solid processing agent tablets are successively charged into the second, third and fourth pockets (352AP, 352BP, 352DP). In the same manner, the solid processing agent tablets are successively discharged outside from the outlet portion 351B (shown in FIG. 10).

In each divided processing agent receiving member 352A, 352B, 352C, 352D, a through-hole is formed in each pocket in the following manner:

When the solid processing agent is accommodated in each pocket, light which passes through the through-hole is shaded by the solid processing agent. When the 4 divided rotors are assembled into one body, the positional phases of the 4 pocket are shifted, and each through-hole is formed in each pocket where the pockets are not overlapped with each other in the axial direction when the 4 divided rotors are assembled into one body. The through-holes of the pockets 352AP and 352DP and those of the pockets 352BP and 352CP are symmetrically arranged on the same circumference with respect to the rotational center of the processing agent receiving member. When the sliding member 356 shades the outlet portion 351B of the housing member 351 (shown in FIG. 9), optical paths of the optical sensors PS1, PS2 of the transmission type detection means composed of light emitting and light receiving elements simultaneously pass through the through-holes of the pockets 352AP, 352CP or the pockets 352BP, 352DP. In this way, existence of the solid processing agent in each pocket can be detected.

An example is described here. Table 1 shows the number of replenishing operations, the number of replenished tablets per one unit replenishing operation, and the number of required tablets in the case where the predetermined number of tablets are replenished into the color development tank, bleaching tank and stabilizing tank of the photosensitive material processing apparatus used for color printing. Concerning the stabilizing tank, it is replenished with the processing agent by the first replenishing operation, and it is not replenished with the processing agent by the second replenishing operation. Therefore, the number of replenishing operations per one unit replenishing operation is 0.5.

TABLE 1

| Name of processing tank | Pocket to be used | Number of replenishing operations | Number of replenished tablets per one unit replenishing operation | Predetermined number |
|---|---|---|---|---|
| Development tank, bleaching and fixing tank | 0 0 0 0 | 1 | 2 | 2 |
| Stabilizing tank | — 0 — — | 2 | 0.5 | 1 |

In Table 1, the pocket to be used is defined as a pocket of the processing agent receiving member in which the solid processing agent is accommodated, and the mark "0" represents that the pocket exists. Further, as another example, the following Table 2 shows the number of replenishing operations conducted when the predetermined number of solid processing agents are replenished to each processing tank of the photosensitive material processing device used for negative color film development. In this connection, concerning the stabilizing tank, it is replenished with the processing agent by the first replenishing operation, and it is not replenished with the processing agent by the second replenishing operation. Therefore, the number of replenishing operations per one unit replenishing operation is 0.5.

TABLE 2

| Name of processing tank | Pocket to be used | Number of replenishing operations | Number of replenished tablets per one unit replenishing operation | Predetermined number |
|---|---|---|---|---|
| Developing tank | 0 — — 0 | 1 | 1 | 1 |
| Bleaching tank | 0 0 0 0 | 1 | 2 | 2 |
| Fixing tank | 0 0 0 0 | 1 | 2 | 2 |
| Stabilizing tank | — 0 — — | 2 | 0.5 | 1 |

In Table 2, the pocket to be used is defined as a pocket formed in the processing agent receiving member in which the solid processing agent is accommodated. The mark "0" is defined as the existence of a pocket.

Figure 9:
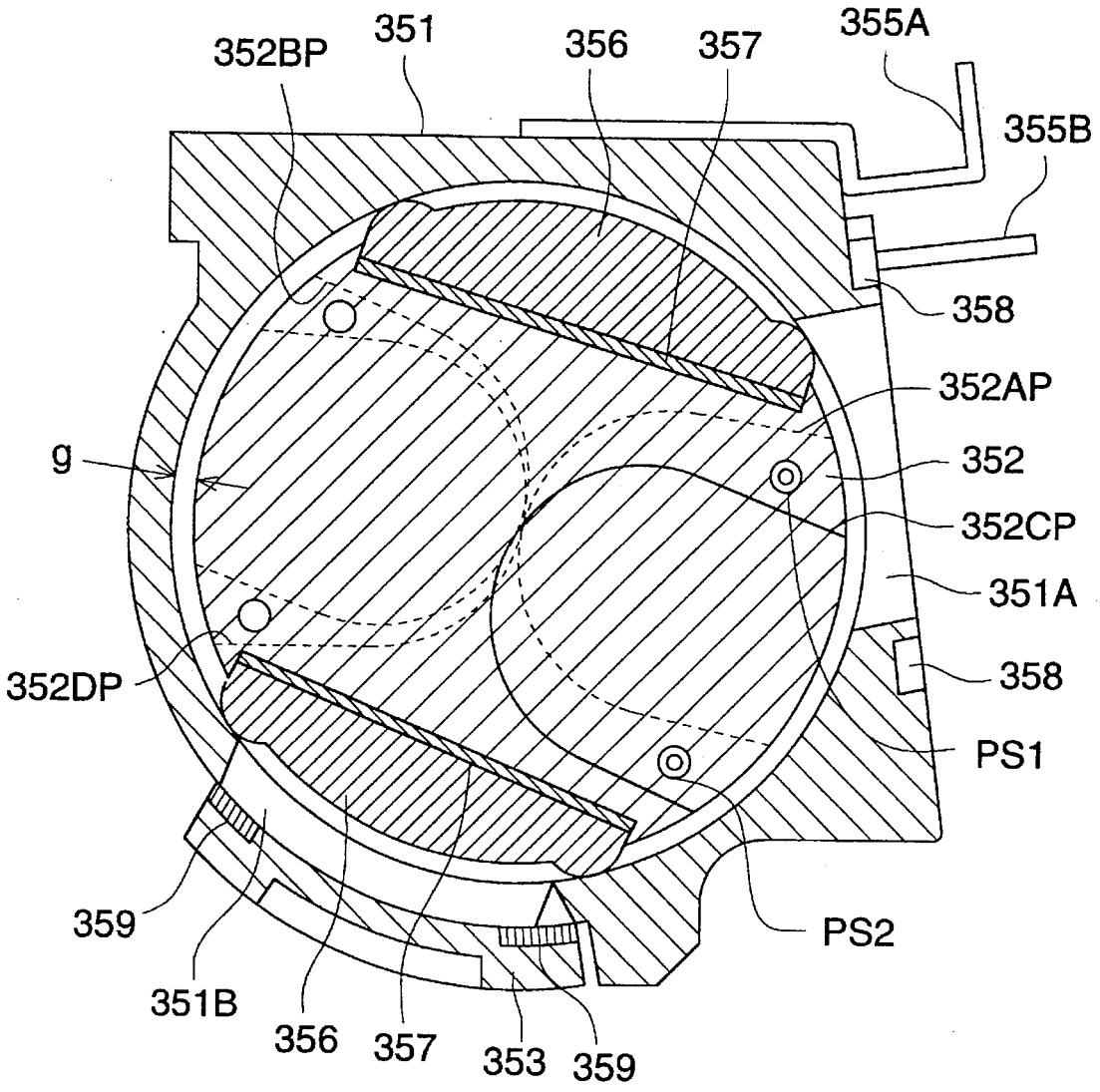
FIG. 9 is a sectional view of the feed means of Example 1.

FIG. 9 is a sectional view of the feed means. As illustrated in the drawing, the outside diameter of the processing agent receiving member 352 is a little smaller than the inside diameter of the housing member 351, and a gap "g" is formed between them. The gap "g" is provided for the following reasons:

When both the diameters are the same, powder of the solid processing agent J gets into the gap and is solidified, so that the processing agent receiving member 352 can not be rotated. When the gap is provided, powder deposited on the inner surface of the housing member can be scraped off by a sliding member, so that powder can be discharged from the outlet portion 351B.

Two sliding members 356 are arranged at two positions on the outer circumference of the processing agent receiving member 352 through resilient members 357. The sliding member 356 is a moisture-proof means. Around the sliding member 356, there are provided protruding portions which come into contact with the internal circumferential surface of the housing member 351 under the condition of line contact. Accordingly, the housing member 351 and the processing agent receiving member 352 are maintained in a moisture-proof condition. A resilient packing 358 is embedded in an inlet portion 351A of the housing member 351. This resilient packing 358 is closely contacted with a discharge opening of the outlet member 332 of the accommodation container 33, so that vapor generated from the processing solution in the processing tank can be stopped and moisture-proof effect can be maintained.

The outlet portion 351B of the housing member 351 is opened and closed by a shutter member 353 described later. A resilient packing 359 is provided on the internal surface the shutter member 353, so that the moisture-proof effect can be maintained by the outlet portion 351B with respect to the outside air.

Figure 10:
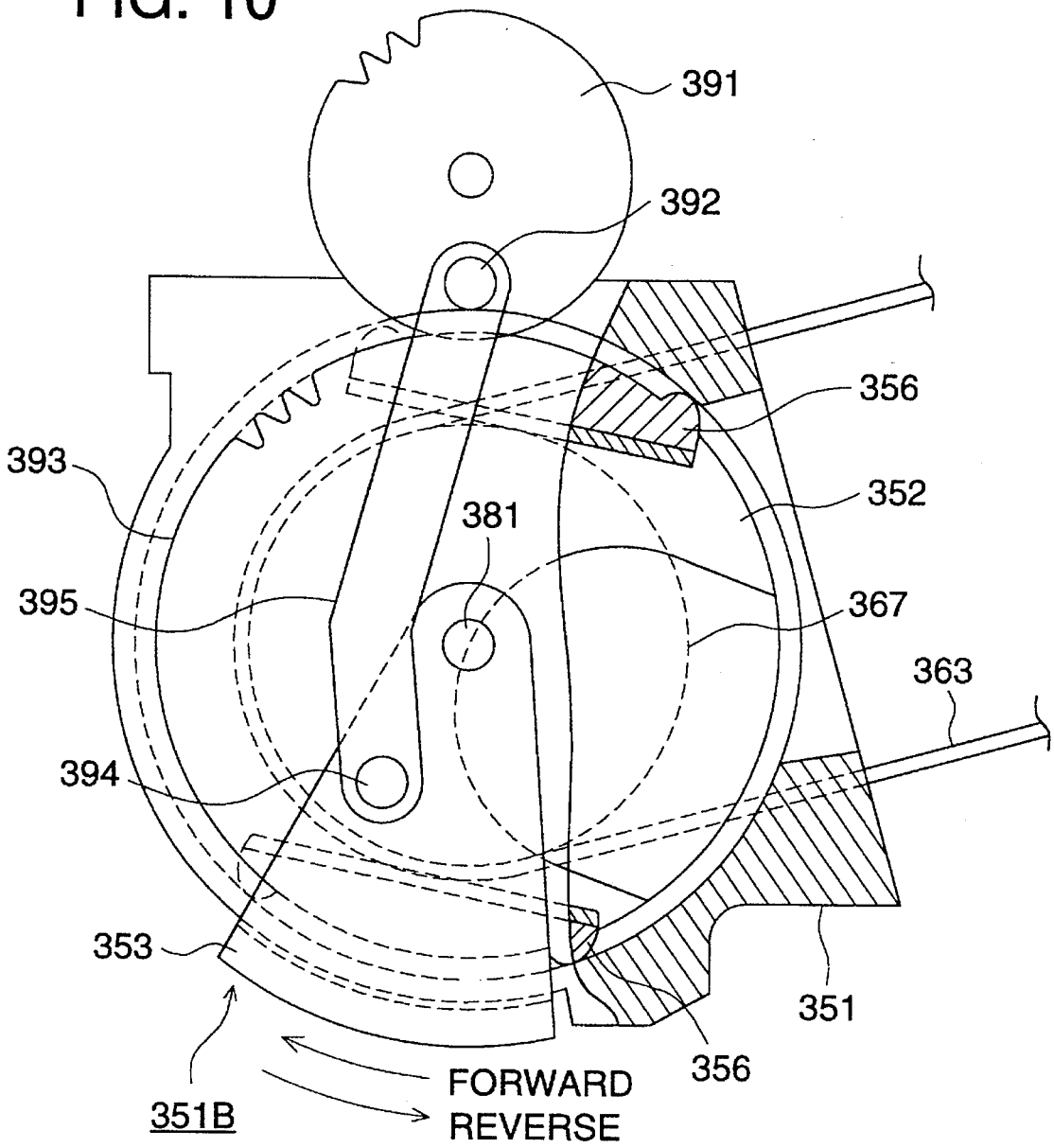
FIG. 10 is a view showing the shutter drive mechanism of Example 1.

FIG. 10 is view for showing the shutter drive mechanism. As illustrated in the drawing, the second drive gear 393 is mounted on the same shaft 381 as that of the processing agent receiving member 352. The second drive gear 393 is synchronously rotated by a timing belt 363 wound around a pulley 367. The first drive gear 391 is meshed with the second drive gear 393 under the condition that a ratio of rotation of the first drive gear 391 is twice as high as that of the second drive gear 393. There is provided a pin 392 in the first drive gear 391. One end of the drive link 395 is engaged with the pin 392, and the other end is engaged with the pin 394 arranged in a shutter member 353 described later. The positional relation is described as follows. The pin 392 of the first drive gear 391 is located at the lowermost position as illustrated in FIG. 10, and the shutter member 353 closes the outlet portion 351B of the housing. The shutter member 353 is rotatably mounted on the shaft 381. By the action of the drive link 395, the shutter member 353 is oscillated twice during the unit replenishing operation, so that the solid processing agent J is replenished at the lowermost position. The sliding member 356 is synchronously rotated on the same shaft as that of the second drive gear 393, so that the sliding member 356 is rotated by 180° during the unit replenishing operation. A positional relation between the sliding member 356 and the shutter member 353 is determined in such a manner that the sliding member 356 also closes the outlet when the shutter member 363 closes the outlet. In this case, two sliding members 356 are provided being opposed to each other at an interval of 180°. Therefore, the two sliding members 356 alternately close the outlet for preventing the moisture from getting into the device. Due to the foregoing construction, when the second drive gear 393 is rotated, the shutter member is oscillated so that the outlet portion 351B can be opened and closed. Accordingly, the moisture is prevented from getting into the device, and it is possible to prevent the solution from splashing when the solid processing agent is charged into the processing tank not shown. In this connection, the replenishing operations of the shutter and the sliding member will be described later referring to FIGS. 12(A) to 12(C).

Figure 11:
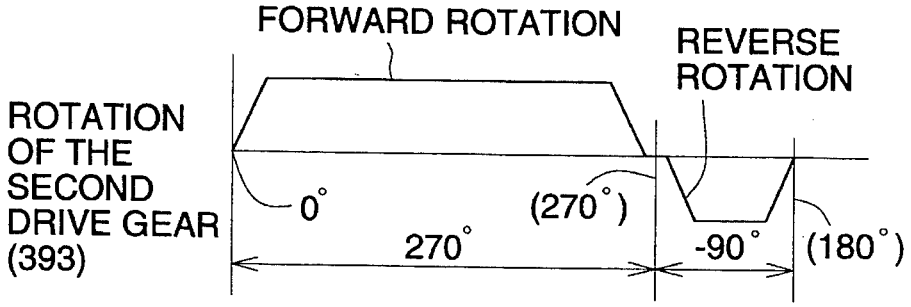
FIGS. 11(A) to 11(D) are operational time charts of the shutter drive mechanism of Example 1.
Figure 11:
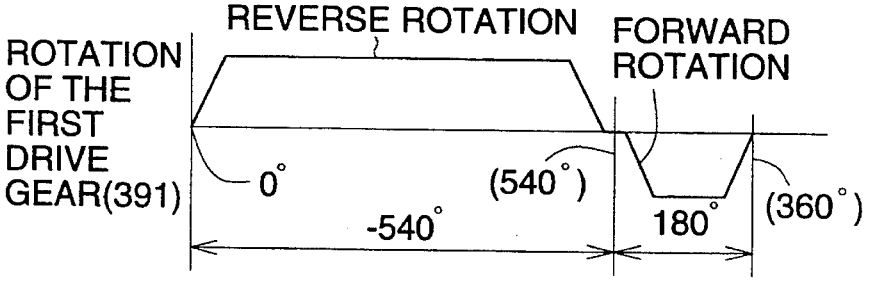
Figure 11:
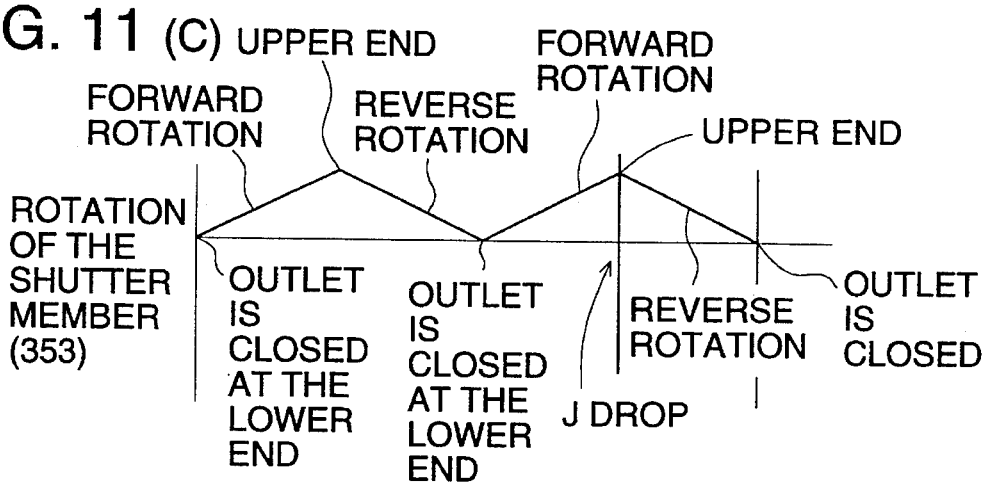
Figure 11:
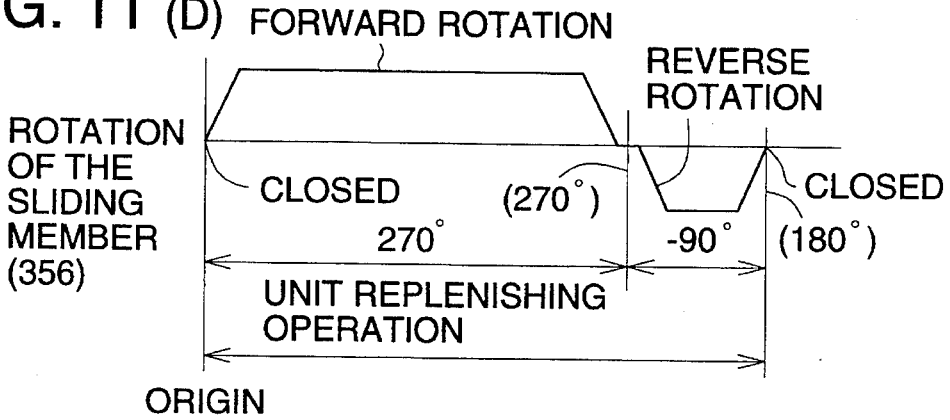

FIGS. 11(A) to 11(D) are operational time charts showing the drive motion of the shutter. With reference to FIGS. 11(A) to 11(D), the shutter drive motion will be explained as follows when the unit replenishing operation is carried out. FIG. 11(A) shows a relation between the rotational angle and the rotational direction of the second drive gear 393. In the timing charts, the initial position corresponds to the origin illustrated in FIGS. 11(A) to 11(D). First, at a point at which the shutter is rotated clockwise (forward rotation) by 270° from the initial position, the shutter is rotated counterclockwise (reverse rotation) by 90° as illustrated in FIG. 11(A). FIG. 11(B) shows a relation between the rotational angle and the rotational direction of the first drive gear 391. First, the first drive gear 391 is rotated by the rotation of the second drive gear 393, and the first drive gear 391 is rotated clockwise (forward rotation) by 180° at a point at which the first drive gear 391 is rotated counterclockwise (reverse rotation) by 540° from the initial position. Further, FIG. 11(C) shows a relation between the rotational angle and the rotational direction of the shutter member 353. First, when the second drive gear 393 is rotated, the shutter member 353 is rotated through the drive link 395 clockwise, counterclockwise, clockwise, and counterclockwise from the initial position. FIG. 11(D) shows a relation between the rotational angle and the rotational direction of the sliding member 356. The sliding member 356 is rotated counterclockwise at a point at which the sliding member 356 is rotated clockwise by 270° from the initial position.

Figure 12:
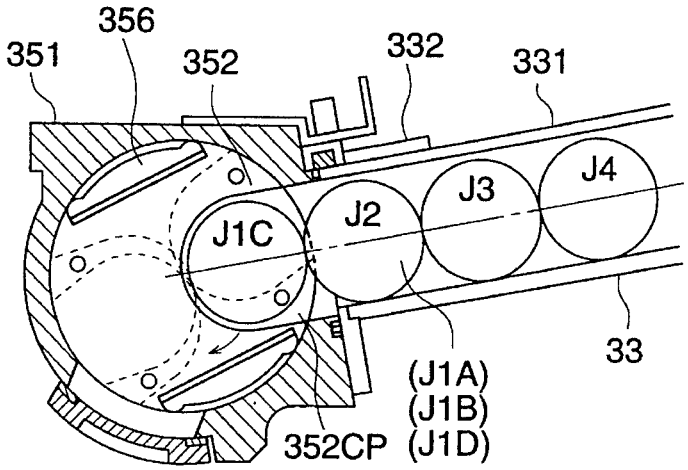
FIGS. 12(A) to 12(C) are sectional views showing a replenishing process for replenishing solid processing agents by the feed means of Example 1.
Figure 12:
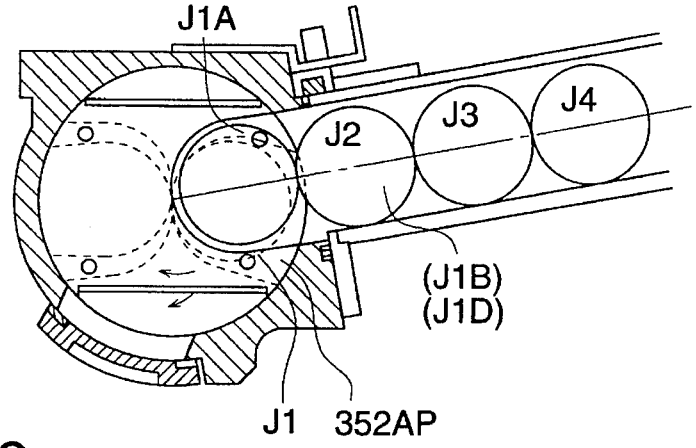
Figure 12:
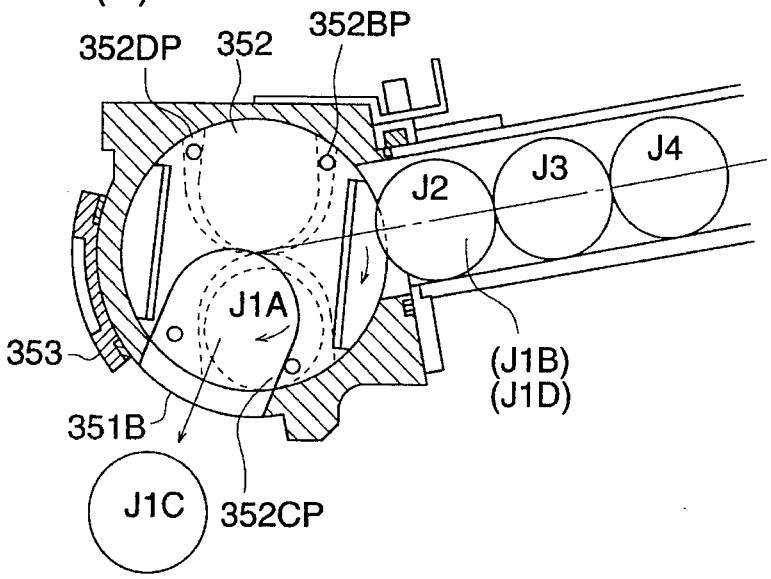

FIGS. 12(A) to 12(C) are sectional views showing a portion of the replenishing process for replenishing the solid processing agent. In this connection, the shutter member 353 has already been explained with reference to FIG. 10, the detailed explanation will be omitted here. FIG. 12(A) shows a condition in which one piece of solid processing agent J1C in the row of C in the accommodating container 33 is put in the pocket 352CP in the row of C of the processing agent receiving member 352. FIG. 12(B) shows a condition in which the solid processing agent J1A is accommodated in the pocket 352AP in the row of A by the rotation of the processing agent receiving member 352. FIG. 12 (C) shows a condition in which the processing agent receiving member is further rotated and the pocket 352CP coincides with the outlet portion 351B of the housing member 351 so that the solid processing agent J accommodated in the pocket 352CP is charged. Although not illustrated in the drawing, when the processing agent receiving member 352 is rotated, the second solid processing agent J is charged. After the two pieces of solid processing agent have been charged, the processing agent receiving member 352 is temporarily rotated counterclockwise by 90°, and the rotation of the processing agent receiving member 352 is stopped at a position where the sliding member 356 fixed to the processing agent receiving member 352 closes the discharge opening. At this moment, the outlet portion 351B is closed by the shutter member 353. Next, the solid processing agents J1B and J1D are successively charged into and discharged from the pockets 352BP in the row of B and the pocket 352DP in the row of D. Then the outlet portion 351B is closed again by the shutter member 353. In this way, when the processing agent receiving member 352 is rotated by a half revolution, two pieces of solid processing agent are successively discharged. After the discharging operation has been completed, the outlet portion 351B is closed by the returning motion of the shutter member 353.

Figure 13:
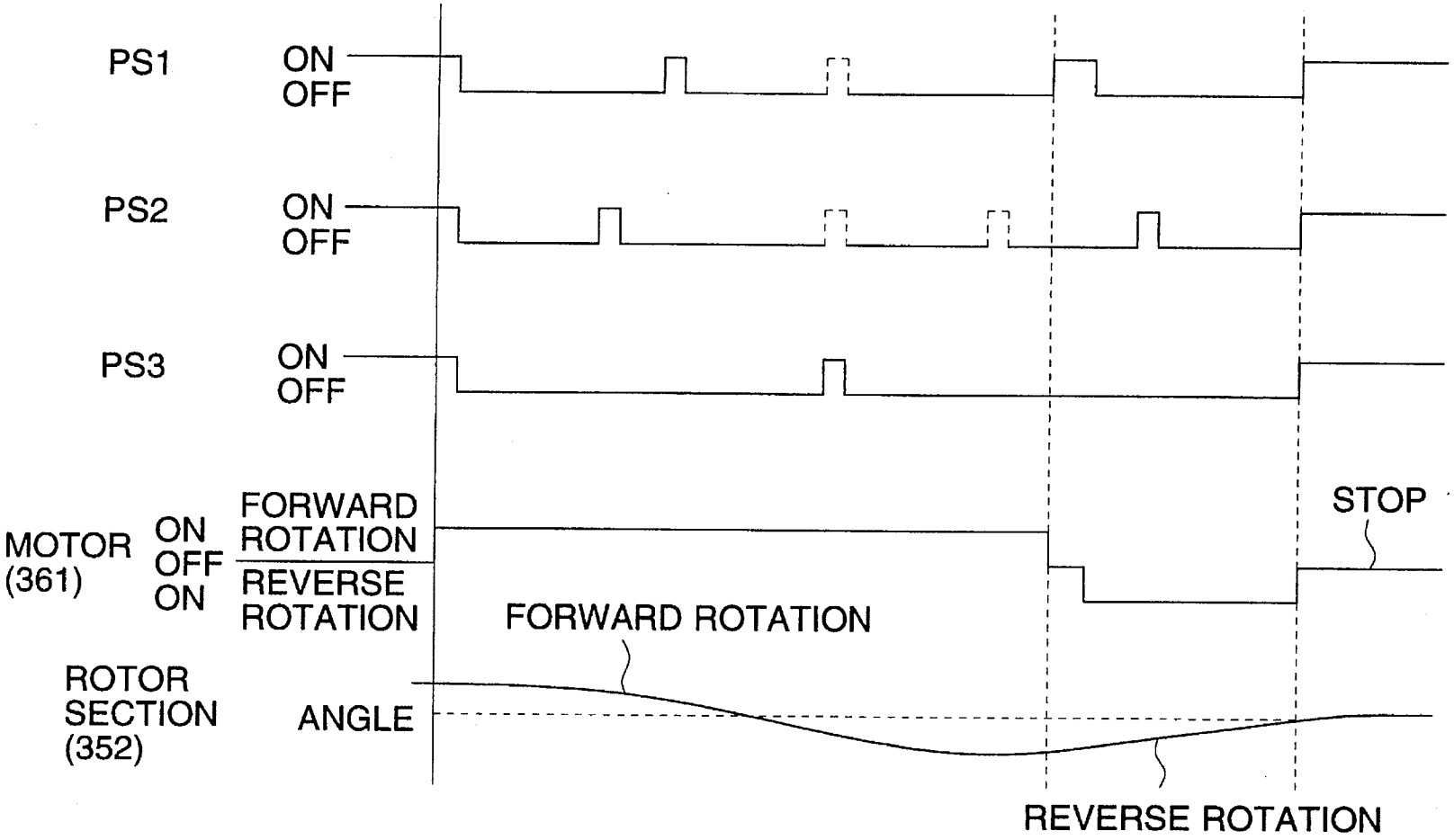
FIG. 13 is an operational time chart showing the operation of the optical sensor, origin optical sensor, motor and rotor of Example 1.

FIG. 13 is a time chart in which the operations of an optical sensor, origin optical sensor, motor and rotor are shown. The optical sensors PS1 and PS2 shown in FIG. 13 are the same as those shown in FIG. 8. The optical sensor PS3 and the motor 361 are the detecting and driving sensor for detecting the origin position shown in FIG. 6. In this case, the origin position is defined as a condition in which the processing agent receiving member 352 is located at a position as illustrated in FIG. 9. At the origin position, the sliding member 356 fixed to the processing agent receiving member 352 closely comes into contact with the discharge opening so that the discharge opening is closed. The processing agent receiving member (rotor) 352 is the same as the rotor illustrated in FIGS. 12(A) to 12(C). Each time chart is shown in the drawing. Detailed explanations will be made with reference to FIGS. 14 and 15 later.

Figure 14:
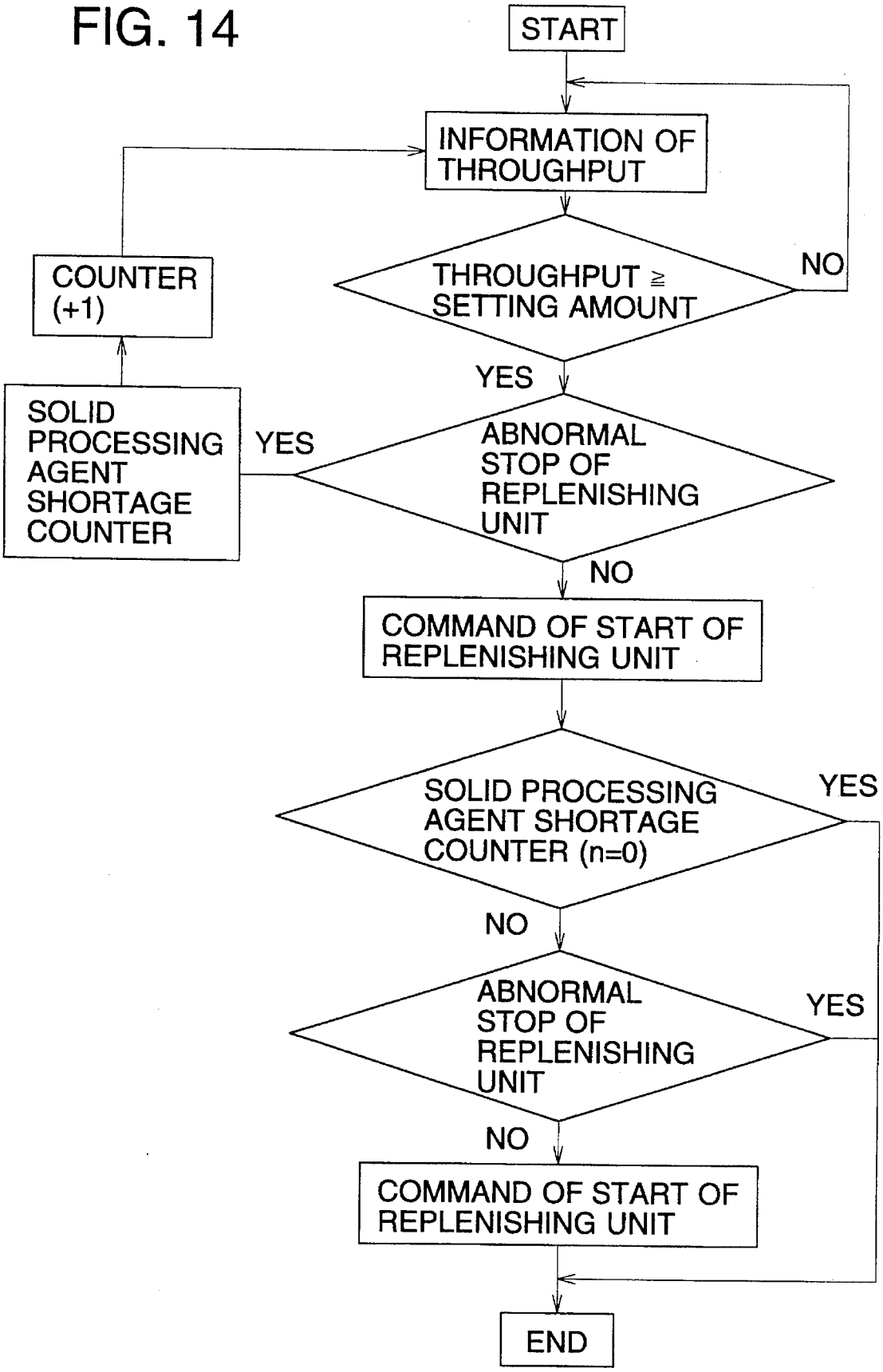
FIG. 14 is a first operational flow chart of the photosensitive material processing apparatus of Example 1.
Figure 15:
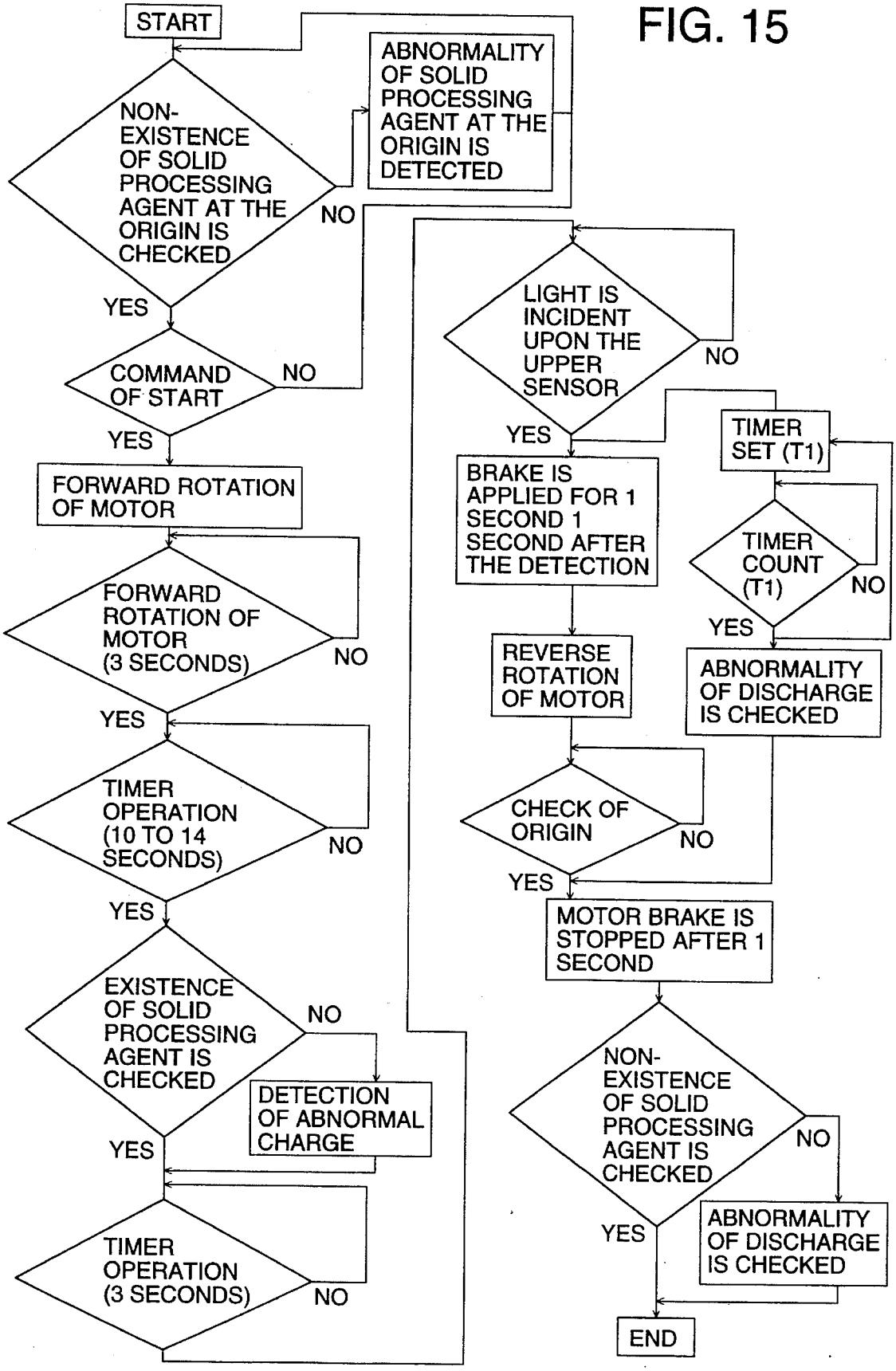
FIG. 15 is a second operational flow chart of the photosensitive material processing apparatus of Example 1.

FIG. 14 is the first operational flow chart of the photosensitive material processing apparatus. The first flow chart is used for a check previously conducted before the start of operation of the photosensitive material processing apparatus. FIG. 15 is the second operational flow chart of the photosensitive material processing apparatus. The second flow chart is the main flow chart used for operating the photosensitive material processing apparatus. In this case, FIGS. 10, 13, 14 and 15 will be explained below. Immediately before or immediately after the start signal is sent, the output signals of the optical sensors PS1 and PS2 are checked. When light is incident on both sensors, in other words, when the optical paths of the optical sensors PS1 and PS2 simultaneously pass through the through-holes of the pockets 352AP and 352CP or the through-holes of the pockets 352DP and 352BP, the processing agent receiving member 352 is stopped at the initial position (origin). In this way, it is checked that no solid processing agent is accommodated in the pocket. In the case where only one through-hole is stopped, a signal of abnormality at the origin at which the solid processing agent exists is outputted. In the case where both through-holes are stopped, a signal of abnormality at the origin at which the solid processing agent exists and a signal of abnormality of the cutout disk 369 at the origin are outputted. At this time, the solid processing agent replenishing operation is prohibited. When light passes through both through-holes, the condition is judged to be normal, and the motor is rotated clockwise (forward direction) so that the processing agent receiving member 352 is rotated clockwise (shown in FIG. 6).

In the process of forward rotation of the processing agent receiving member 352, the optical sensor PS2 detects the through-hole of the pocket 352AP or 352DP. Next, the optical sensor PS1 detects the through-hole of the pocket 352BP or 52CP. Then the processing agent receiving member 352 is further rotated, and the pocket 352BP or 352CP coincides with the inlet portion 351A, so that the solid processing agent in the accommodation container rolls out from the container and is fed into the pocket (shown in FIG. 12(A) to 12(C)). Next, the pocket 352DP or 352AP coincides with the inlet portion 351A, and the solid processing agent is fed into the pocket in the same manner. When the processing agent receiving member 352 is further rotated, the through-hole of the pocket 352BP or 352CP and the through-hole of the pocket 352DP or 352AP simultaneously pass through the optical sensors PS2 and PS1.

At this time, the solid processing agent accommodated in the pocket stops light, so that the solid processing agent is detected by the optical sensors PS2 and PS1 (shown by-a broken line in FIG. 13). On the other hand, when light is incident on the optical sensor, the occurrence of abnormal feeding of the solid processing agent is detected. When the processing agent receiving member is further rotated, the through-hole of the pocket 352DP or 352AP passes through the optical sensors PS2.

When light is stopped by the solid processing agent accommodated in the pocket, the solid processing agent is detected. When light is incident on the optical sensor, the occurrence of abnormal feeding of the solid processing agent is detected.

The processing agent receiving member 352 is further rotated, and the pocket 352BP or 352CP coincides with the outlet portion 351B, so that the solid processing agent J accommodated in the pocket is discharged from the pocket and charged into the constant temperature tank 2.

Next, the pocket 352DP or 352AP coincides with the outlet portion 351B, and the solid processing agent J accommodated in the pocket is charged into the constant temperature tank 2. The processing agent receiving member 352 is further rotated, and the optical sensor PS1 detects the through-hole of the pocket 352BP or 352CP in which the solid processing agent has been accommodated before and also detects the through-hole of the pocket 352CP or 352BP located at the opposed position in the processing agent receiving member. By the detection signal provided in the above manner, the motor 361 (shown in FIG. 6) is stopped for a predetermined period of time (0.1 to 1.0 sec), so that the forward rotation of the processing agent receiving member 352 is stopped. Next, the motor 361 is reversed, so that the reverse rotation of the processing agent receiving member 352 is started. in this case, the pocket 352CP or 352BP is not coincident with the inlet portion 351A, so that the solid processing agent is not fed from the accommodating container to the processing agent receiving section.

When the processing agent receiving member 352 is reversed, the optical sensor PS2 detects the through-hole of the pocket 352DP or 352AP. Next, the optical sensors PS1 and PS2 simultaneously detect the through-hole of the pocket 352DP or 352AP and the through-hole of the pocket 352BP or 352CP. By the AND condition output of the inputted light signals sent from the two sensors, the brake (for example the electric brake) is applied to the motor 361 for 0.1 to 1.0 second, and the motor 361 is stopped. After that, the brake is released, and the origin stop condition is maintained. After the stop, the output of the optical sensor PS1 and the output of the optical sensor PS2 are checked. In the case where only one of the sensors detects the light signal, it is judged that the solid processing agent has abnormally dropped from the processing agent receiving member 352. In the case where neither of the sensors detects the light signal, it is judged that the solid processing agent has abnormally dropped from the processing agent receiving member 352, or alternatively it is judged that the processing agent receiving member 352 has not stopped at the origin position. After the aforementioned processes, the unit replenishing operation of the solid processing agent is completed.

According to the present invention, the solid processing agent is replenished in the manner described above, the solid processing agent to be charged into the processing tank is not affected by the moisture sent from the processing tank while it is waiting for the charging operation. Consequently, the solid processing agent is fed in a good condition.

In the case where the solid processing agent has not dropped from the pocket in the above sequence, the AND condition of the optical sensors PS1 and PS2 is not satisfied, and it is impossible for the processing agent receiving member to stop at the initial position (origin position). For this reason, the occurrence of abnormal dropping of the solid processing agent and the occurrence of abnormality of the origin position are outputted as follows:

The time that has passed after the start of forward rotation of the motor is counted by the timer. The counted time is compared with the data of the predetermined time necessary for one replenishing operation. When the counted time is coincident with the data of the predetermined time or the counted time is longer than the data of the predetermined time, the brake is applied to the motor after the detection of the cutout portion by the optical sensor PS3, wherein the time of detection of the cutout portion by the optical sensor PS3 (shown in FIG. 6) is previously adjusted to the time of detection of the origin. After the optical sensor PS3 has detected the cutout portion, the brake is applied to the motor so as to stop it. In this way, the occurrence of abnormality is outputted.

The occurrence of abnormality of no solid processing agent is outputted and the following replenishing operation is prohibited in the following case:

From the memory of data representing an amount of the solid processing agent in the accommodation container, and also from the memory of the number of solid processing agent replenishing operations counted after the accommodating container replacing signal was outputted, the value of the memory of the number of replenishing operations is increased to a value not less than 1.

[EXAMPLE 2]

Another example of the feed means is described here. In this example, when the processing agent receiving member (rotor) is rotated by one revolution (360°), the solid processing agent is received and replenished to the processing agent, and finally the solid processing agent is subjected to the moisture-proof processing. In this connection, the explanation of the same structure as that of Example 1 is omitted here, and like parts are identified by the same reference character.

Figure 16:
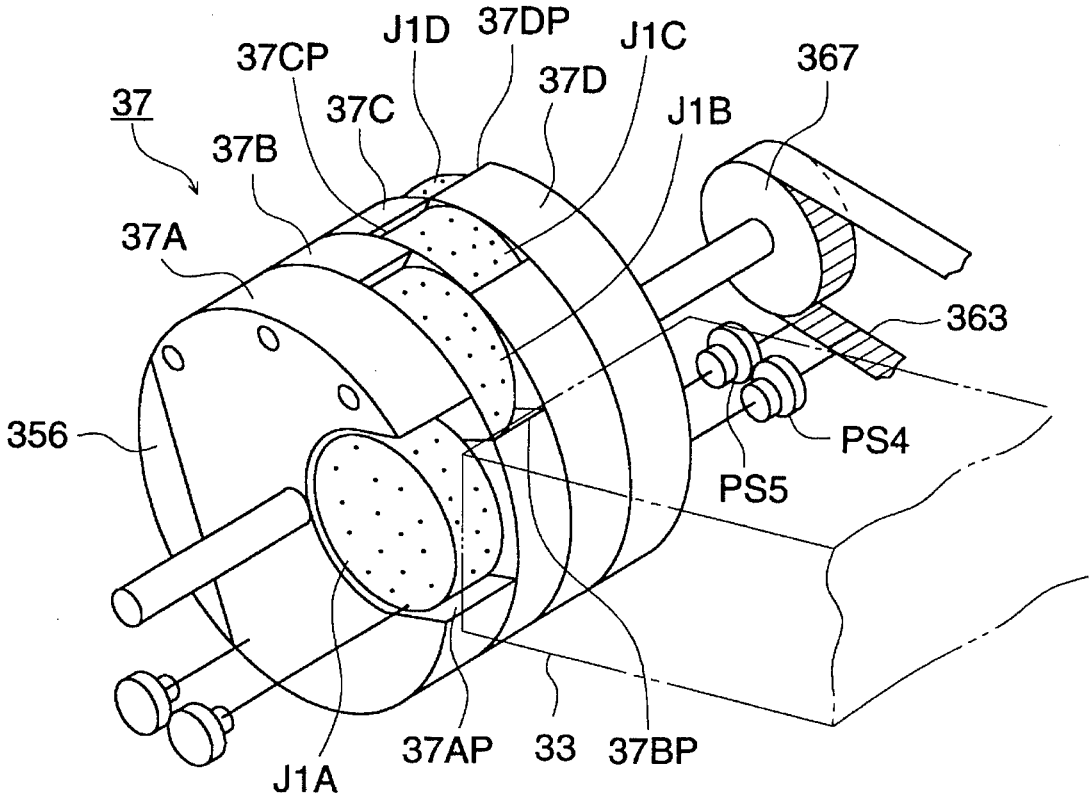
FIG. 16 is a perspective view of the feed means of Example 2.

FIG. 16 is a perspective view of the feed means. As illustrated in the drawing, the processing agent receiving member 37 includes 4 divided rotors 37A, 37B, 37C and 37D which are mounted on the same shaft. Each divided rotor is provided with one pocket 37AP, 37BP, 37CP, 37DP. Each pocket is capable of accommodating one piece of solid processing agent J1A, J1B, J1C, J1D. As illustrated in FIG. 16, the positional phases of the pockets 37AP, 37BP, 37CP, 37DP are shifted from each other. When the processing agent receiving member is rotated by one revolution, the solid processing agent J1A is discharged from the discharge port of the accommodating container 33 and charged into the first pocket 37AP. Then the solid processing agents are successively charged into the second, third and fourth pocket 37BP, 37CP, 37DP in the same manner. The charged solid processing agents are successively replenished to a constant temperature tank (not shown) from the outlet portion 351B illustrated in FIG. 17.

When 4 divided rollers are assembled into one body under the condition that the solid processing agents are respectively provided in the pockets of the divided rotors 37A, 37B, 37C, 37D, a through-hole is formed in each pocket in the following manner:

When the solid processing agent is accommodated in each pocket, light which passes through the through-hole is shaded by the solid processing agent. When the 4 divided rotors are assembled into one body, the positional phases of the 4 pocket are shifted, and each through-hole is formed in each pocket where the pockets are not overlapped with each other in the axial direction when the 4 divided rotors are assembled into one body. The through-hole of each pocket is arranged on the circumference of the concentric circle, the center of which is the rotational center of the processing agent receiving member. The optical sensor $4, which is a transmission type detecting means composed of a light emitting element and a light receiving element, is arranged at the position of the accommodating container. When no solid processing agents are accommodated in the pockets, a beam of light simultaneously passes through the through-holes of the pockets 37AP, 37BD, 37CP and 37DP, so that the existence of the solid processing agent in each pocket is checked. The optical sensor PS5 of the detecting means is arranged in the output portion 351B shown in FIG. 17 in the same manner. This optical sensor PS5 detects whether or not the processing agent receiving member 352 is at the origin position and also detects whether or not the sliding member 356 closes the discharge port. This optical sensor PS5 also detects whether or not the solid processing agent has dropped from each pocket of the processing agent receiving member 352.

Figure 17:
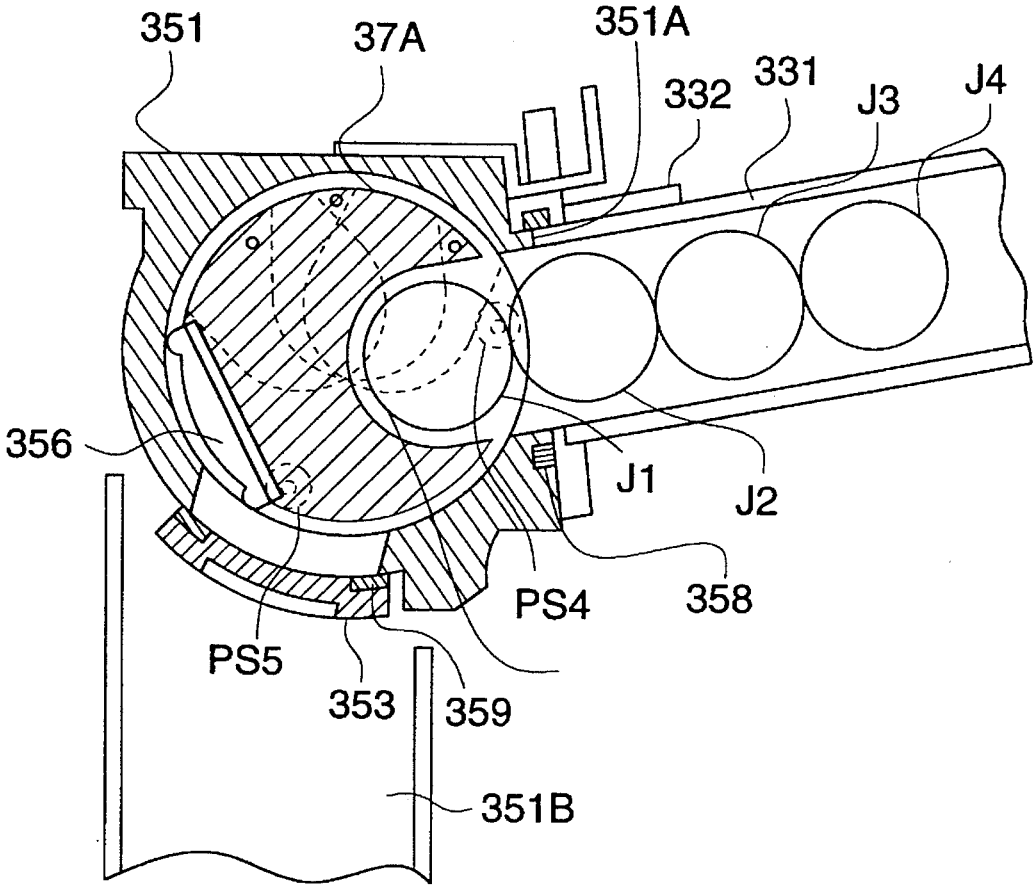
FIG. 17 is a sectional view of the feed means of Example 2.

FIG. 17 is a sectional view of the feed means. In the same manner as that of Example 1, one piece of sliding member 356 is attached onto the outside diameter of the processing agent receiving member 37. When the protruding portion of the sliding member 356 comes into contact with the inside diameter of the housing member 351 under the condition of line contact, the moisture-proof condition can be maintained between the housing member 351 and the processing agent receiving member 37.

A resilient packing member 358 is embedded in the inlet portion 351A of the housing member 351. The resilient packing member 358 is closely contacted with the discharge opening of the outlet member 332 of the accommodating container 33, so that the solid processing agent can be prevented from being moistened by the atmosphere (vapor generated from the processing agent in the processing tank).

The outlet portion 351B of the housing member 351 is capable of being opened and closed by the action of the shutter member 353 provided outside.

A resilient packing member 359 adheres onto the inside surface of the shutter member 353. Therefore, the outlet portion 351B can be prevented from being moistened by the outside air.

The shutter member 353 is reciprocated along a portion of the outer circumference of the housing member 351 by the action of a link mechanism linked with the rotation of the processing agent receiving member 37. Therefore, the outlet portion 351B is opened when the solid processing agent is replenished. After the solid processing agent J has been replenished to a processing tank not shown, the shutter member 353 closes the outlet portion 351B being linked with the rotation of the processing agent receiving member 37.

Due to the foregoing construction, after the processing agent receiving member has been rotated clockwise and 4 solid processing agents have been successively discharged, the shutter member is closed and the solid processing agents are prevented from being moistened.

In this example, the number of the divided rotors of the processing agent receiving member is four, however, it should be noted that the present invention is not limited to the specific example, and variations may be adopted.

[EXAMPLE 3]

In this example, a rotational direction of the processing agent receiving member (rotor) of the feed means is appropriately changed so that a predetermined number of pieces of solid processing agents can be replenished.

Figure 18:
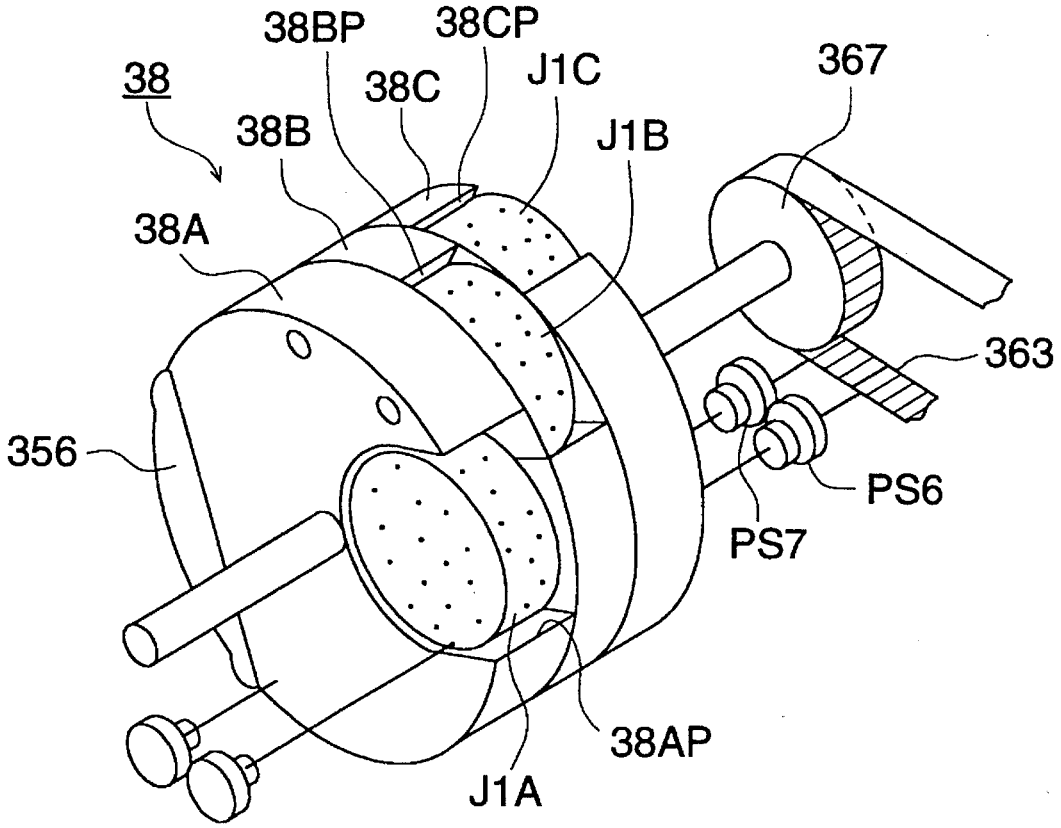
FIG. 18 is a perspective view of the feed means of Example 3.

FIG. 18 is a perspective view of the feed means. As illustrated in the drawing, the processing agent receiving member 38 includes 3 divided rotors 38A, 38B and 38C which are mounted on the same shaft. Each divided rotor is provided with one pocket 38AP, 38BP, 38CP. Each pocket is capable of accommodating one piece of solid processing agent. As illustrated in the drawing, the positional phases of the pockets 38AP, 38BP, 38CP are shifted from each other. When the processing agent receiving member 38 is rotated by one revolution, the solid processing agent J1A is discharged from the discharge port of the accommodating container 33 shown in FIG. 19 and charged into the first pocket 38AP. Then the solid processing agents are successively charged into the second and third pocket 38BP and 38CP in the same manner.

When the 3 divided processing agent receiving members 38A, 38B, 38C are assembled into one body, their positional phases are shifted in such a manner that a through-hole is formed at a position in each pocket where two pockets are not overlapped with each other. The through-hole in each pocket is located on the same circumference, the center of which is the same as that of the processing agent receiving member. The optical sensor PS6, which is a transmission type detecting means, composed of a light emitting and a light receiving element, is arranged at a position of the accommodating container. When the solid processing agents are not accommodated in the pockets, a beam of detecting light simultaneously passes through the through-holes 38AP, 38CP, 38BP, so that the existence of the solid processing agent in each pocket is checked. The optical sensor PS7, which is another detecting means, is arranged in the output section 351B illustrated in FIG. 19. This optical sensor PS7 detects whether or not the processing agent receiving member 352 is at the origin position and also detects whether or not the sliding member 356 closes the discharge port. This optical sensor PS7 also detects whether or not the solid processing agent has dropped from each pocket of the processing agent receiving member 352.

Figure 19:
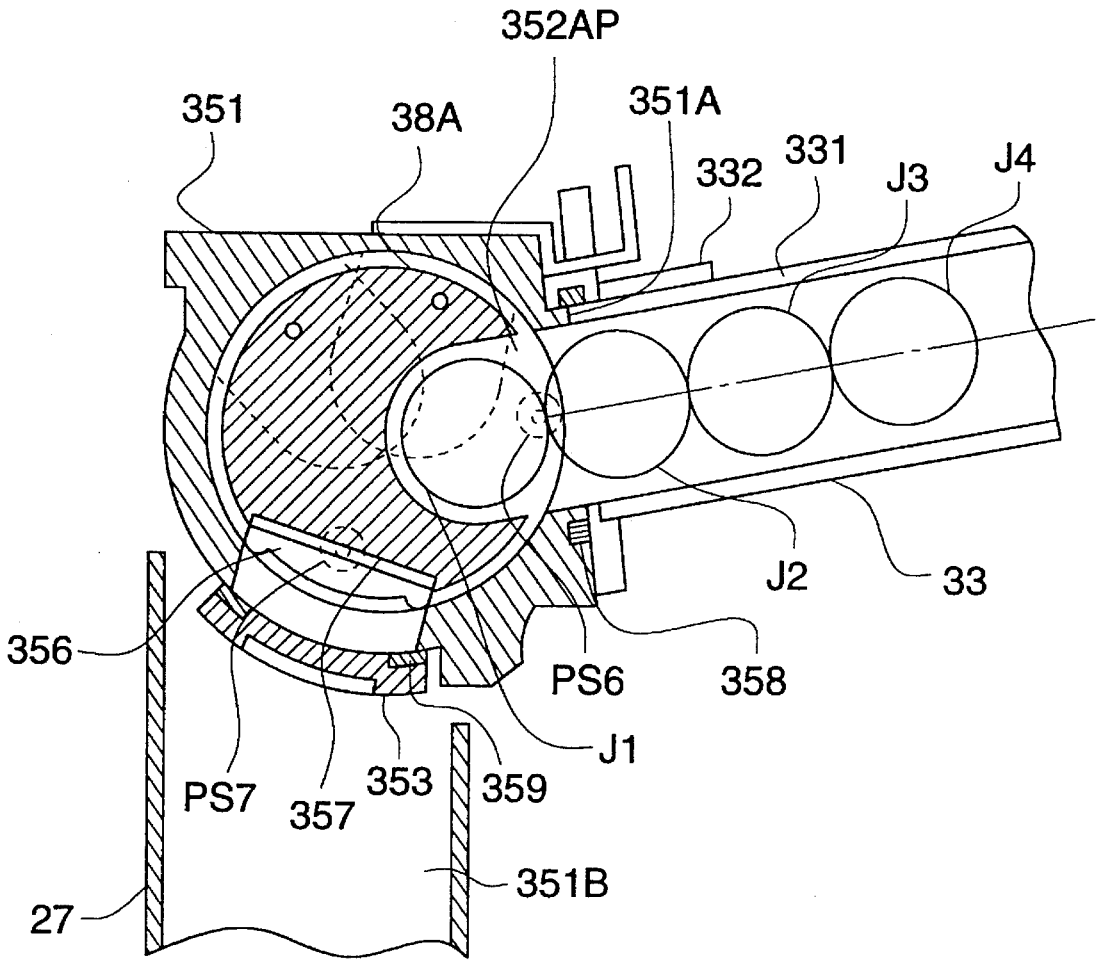
FIG. 19 is a sectional view of the feed means of Example 3.

FIG. 19 is a sectional view of the feed means. One piece of sliding member 356 is attached onto the outside circumference of the processing agent receiving member 38 through the resilient member 357. When the protruding portion of the sliding member 356 comes into contact with the inside circumference of the housing member 351 under the condition of line contact, the moisture-proof condition can be maintained between the housing member 351 and the processing agent receiving member 38. A resilient packing member 358 is embedded in the inlet portion 351A of the housing member 351. The resilient packing member 358 is closely contacted with the discharge opening of the outlet member 332 of the accommodating container 33, so that the solid processing agent can be prevented from being moistened by the atmosphere (vapor generated from the processing agent in the processing tank).

The outlet portion 351B of the housing member 351 is capable of being opened and closed by the action of the shutter member 353 provided outside.

A resilient packing member 359 adheres onto the inside surface of the shutter member 353. Therefore, the outlet portion 351B can be prevented from being moistened by the outside air.

The shutter member 353 is reciprocated along a portion of the outer circumference of the housing member 351 by the action of a link mechanism linked with the rotation of the processing agent receiving member 38. Therefore, the outlet portion 351B is opened when the solid processing agent J is replenished. After the solid processing agent J has been replenished to a processing tank not shown, the shutter member 353 closes the outlet portion 351B being linked with the rotation of the processing agent receiving member 38.

In this example, the number of the divided rotors of the processing agent receiving member is three, however, it should be noted that the present invention is not limited to the specific example, and variations may be adopted.

Due to the above construction of the apparatus of the present invention, the following effects can be provided.

The first effect is described as follows. The throughput is detected by the throughput detecting means. When the throughput is increased to a predetermined value, a predetermined amount of the solid processing agent is accurately replenished, and the replenishing time is accurately controlled.

The second effect is described as follows. The processing agent receiving member is provided with a holding section for holding the solid processing agent, and the existence of the solid processing agent in the processing agent receiving member is detected by the detecting means. Therefore, the conveyance condition of the solid processing agent can be checked.

The third effect is described as follows. When the solid processing agent is not fed from the accommodating container to the holding section of the processing agent receiving member, the occurrence of abnormality is detected by the detecting means for detecting the existence of the solid processing agent. When the solid processing agent is not discharged from the holding section of the processing agent receiving member into the processing tank, the occurrence of abnormal discharge is detected by the detecting means. Accordingly, the occurrence of abnormality can be immediately detected.

The fourth effect is described as follows. In the normal operation, the solid processing agent is charged in accordance with the throughput information detected by the throughput information detecting means for detecting the throughput of the photosensitive material. When the operation is in an abnormal condition, while the operation is continued, an amount of lack of the solid processing agent is stored, and after the recovery of the abnormal condition, the amount of lack of the solid processing agent stored in the memory is called and continuously replenished. Accordingly, even when an amount of the solid processing agent is insufficient, the operation is not immediately stopped, and it is possible to continue the operation until a new accommodating container is prepared. The emergency operation is carried out in the above manner.

The fifth effect is described as follows. There is provided a holding section for holding the solid processing agent. The held solid processing agent is prevented from being moistened by the moisture-proof means. The processing agent receiving member is rotated by the drive means in one direction so that the solid processing agent can be conveyed. When the processing agent receiving member is rotated in the reverse direction, the outlet section of the housing is closed by the moisture-proof means, so that the solid processing agent in the accommodating container can be prevented from being moistened. Accordingly, while the solid processing agent is kept in the accommodating container, it can be prevented from being moistened without being stopped in the feed means. Therefore, the solid processing agent can be positively conveyed.

The sixth effect is described as follows. In the apparatus of the invention, rows of the solid processing agents are provided in the accommodating container, and the same number of rows of the solid processing agents are provided in the processing agent receiving member, and the holding section for holding the solid processing agents is provided. Accordingly, in addition to the fifth effect, the solid processing agent can be positively inserted into and discharged from the processing agent accommodating member.

The seventh effect is described as follows. The housing member is provided with the inlet and outlet sections. Further, the processing agent receiving member is provided, on the circumferential surface of which the solid processing agent is rotatably held. Further, the processing agent receiving member having the moisture-proof means is provided. The outlet portion is opened and closed by the shutter member, and only when the processing agent is replenished, the outlet portion is opened for preventing the processing agent from being moistened. Accordingly, great moisture-proof effects can be provided.

What is claimed is:

1. A solid processing agent device for use in a light-sensitive material processing apparatus provided with a processing tank for storing therein a processing solution by which a light-sensitive material is processed, the solid processing agent device comprising:

(a) storing means for storing a solid processing agent;

(b) replenishing means for replenishing said processing solution with the agent supplied from the storing means, the replenishing means including:

(i) a housing member having an opening through which the agent is replenished to the processing tank from the replenishing means; and (ii) a receiving member provided in the housing member, the receiving member having an initial position, a receiving position and a replenishing position, said receiving member being movable from said initial position to said receiving position for receiving the agent, and said receiving member being movable from said receiving position to said replenishing position for replenishing the agent to the processing tank through said opening;

(c) first detecting means for detecting said receiving member and outputting a first signal when said receiving member is not located at the initial position;

(d) second detecting means for detecting whether the agent is in said receiving member at said initial position, and outputting a second signal when the agent remains in the receiving member at said initial position;

(e) third detecting means for detecting whether the agent is in said receiving member after being positioned at said receiving position, and for outputting a third signal when the agent is not received in said receiving member at said receiving position;

(f) fourth detecting means for detecting the agent which is received in said receiving member at said receiving position, and outputting a fourth signal when the agent is not replenished to the processing tank at said replenishing position; and (g) controller means for controlling said receiving member not to start moving when said controller means receives the first or second signal, and for controlling said receiving member to stop moving when said controller means receives said third or fourth signal.

2. The solid processing agent device according to claim 1, wherein:

said storing means includes a first plurality of rows, each of said first plurality of rows storing the agent; and said receiving member includes a second plurality of rows corresponding to said first plurality of rows, each row of said second plurality of rows being movable between said initial position, said receiving position and said replenishing position independent of at least one other of the second plurality of rows, and said second plurality of rows being arranged in a moving direction thereof so that a difference of phase is provided with respect to at least two of said second plurality of rows.

3. The solid processing agent replenishing device according to claim 2, wherein each of said second plurality of rows of said receiving member has a through-hole for operative association with the first, second, third and fourth detecting means.

4. A solid processing agent device for use in a light-sensitive material processing apparatus provided with a processing tank for storing therein a processing solution by which a light-sensitive material is processed, the solid processing agent device comprising:

(a) storing means for storing a solid processing agent;

(b) replenishing means for replenishing said processing solution with the agent supplied from said storing means, the replenishing means including:

(i) a housing member having an opening through which the agent is replenished to the processing tank from said replenishing means; and (ii) a receiving member provided in said housing member, said receiving member having an initial position, a receiving position and a replenishing position, said receiving member being movable from said initial position to said receiving position for receiving the agent, and said receiving member being movable from said receiving position to said replenishing position for replenishing the agent to the processing tank through said opening;

(c) detecting means for:

(i) detecting said receiving member and outputting a first signal when said receiving member is not located at said initial position;

(ii) detecting whether an agent is in said receiving member at said initial position, and outputting a second signal when the agent remains in said receiving member at said initial position;

(iii) detecting whether the agent is in said receiving member after being positioned at said receiving position, and for outputting a third signal when the agent is not received in said receiving member at said receiving position;

(iv) detecting the agent which is received in said receiving member at said receiving position, and outputting a fourth signal when the agent is not replenished to the processing tank at said replenishing position; and (d) controller means for controlling said receiving member not to start moving when said controller means receives the first or second signal, and for controlling said receiving member to stop moving when said controller means receives said third or fourth signal.

5. The solid processing agent device according to claim 4, wherein:

said storing means includes a first plurality of rows, each of said first plurality of rows storing the agent; and said receiving member includes a second plurality of rows corresponding to said first plurality of rows, each row of said second plurality of rows being movable between said initial position, said receiving position and said replenishing position independent of at least one other of said second plurality of rows, and said second plurality of rows being arranged in a moving direction thereof so that a difference of phase is provided with respect to at least two of said second plurality of rows.

* * * * *